US008011991B2

(12) United States Patent
Asperas

(10) Patent No.: US 8,011,991 B2
(45) **Date of Patent: *Sep. 6, 2011**

(54) APPARATUS FOR FACILITATING THE CONSTRUCTION OF A SNOW MAN/WOMAN

(76) Inventor: Ignacio Marc Asperas, Melville, NY (US)

( * ) Notice: Subject to any disclaimer, the term of this patent is extended or adjusted under 35 U.S.C. 154(b) by 1220 days.

This patent is subject to a terminal disclaimer.

(21) Appl. No.: 11/342,601

(22) Filed: Jan. 31, 2006

(65) Prior Publication Data

US 2006/0172654 A1 Aug. 3, 2006

(51) Int. Cl.
*A63H 33/00* (2006.01)

(52) U.S. Cl. ..... 446/71; 446/73; 446/74

(58) Field of Classification Search ..... 156/273.1; 29/900; 446/70; 62/1
See application file for complete search history.

(56) References Cited

U.S. PATENT DOCUMENTS

| | | | | | |
|---|---|---|---|---|---|
| 4,327,504 | A * | 5/1982 | Welsch | 36/122 |
| 4,351,157 | A * | 9/1982 | Zeigler | 62/1 |
| 5,485,701 | A * | 1/1996 | Hecht | 52/80.1 |
| 5,522,181 | A * | 6/1996 | Ellsworth | 52/2.15 |
| 7,178,342 | B1 * | 2/2007 | Knapp | 62/1 |

FOREIGN PATENT DOCUMENTS

JP 2004140934 * 5/2004

* cited by examiner

*Primary Examiner* — Gene Kim
*Assistant Examiner* — Urszula M Cegielnik

(57) ABSTRACT

A building component for facilitating a construction of a snow man/woman. A spherically-shaped body is provided that has an outer surface and an interior, the interior substantially lighter than when the interior is filled with snow. An adhesion surface is provided on the outer surface of the spherically-shaped body that substantially increases the ability of the outer surface to adhere snow to the spherically-shaped body. The spherically-shaped body and adhesion surface form a building component for facilitating the construction of the snow man/woman. The adhesion surface may be an electrically charged surface in combination with a texture or alone. The electric charge may be generated by a generator that may be disposed with the body.

15 Claims, 13 Drawing Sheets

Figure 2a
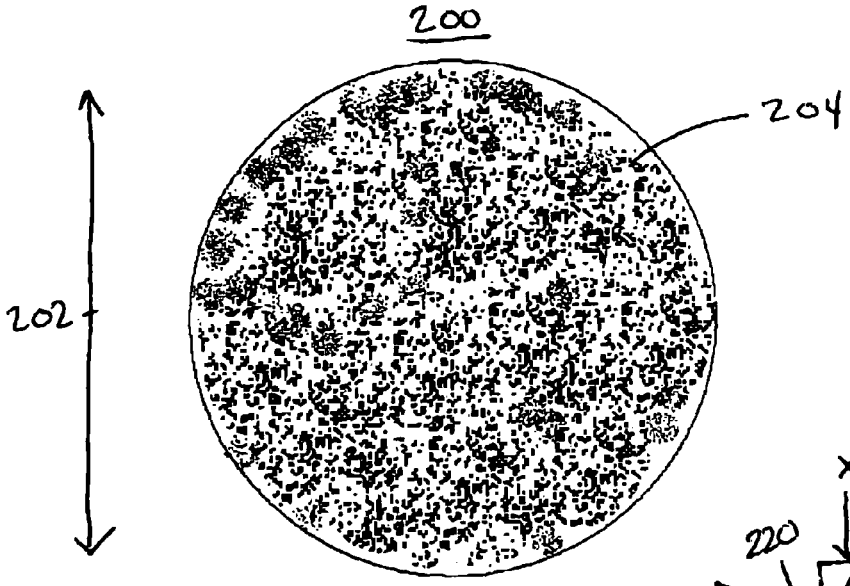
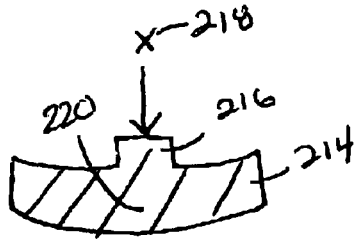
FIGURE 2D
Figure 2b
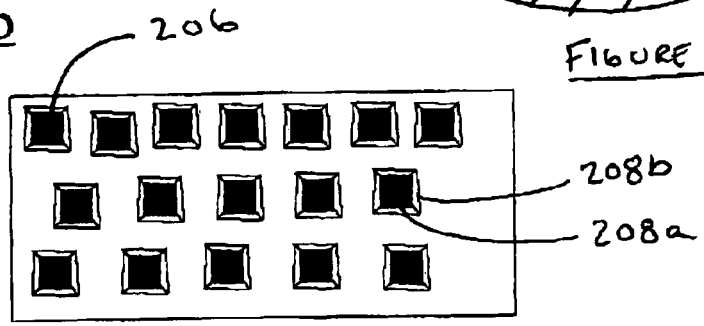
Figure 2c
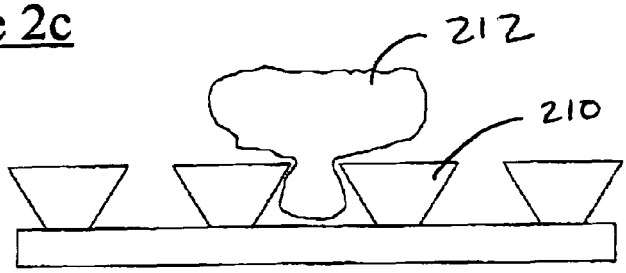

Figure 3c
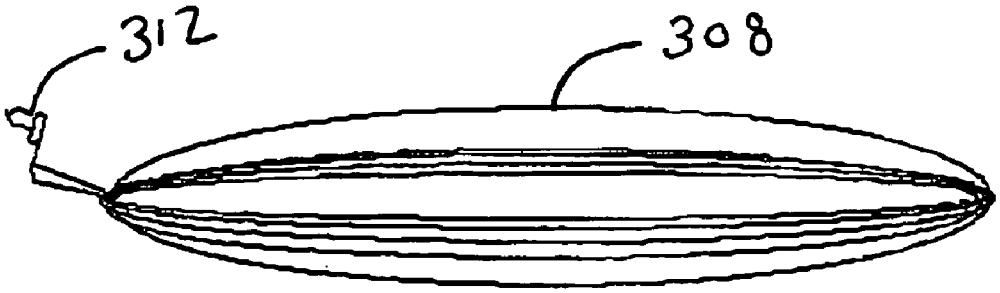
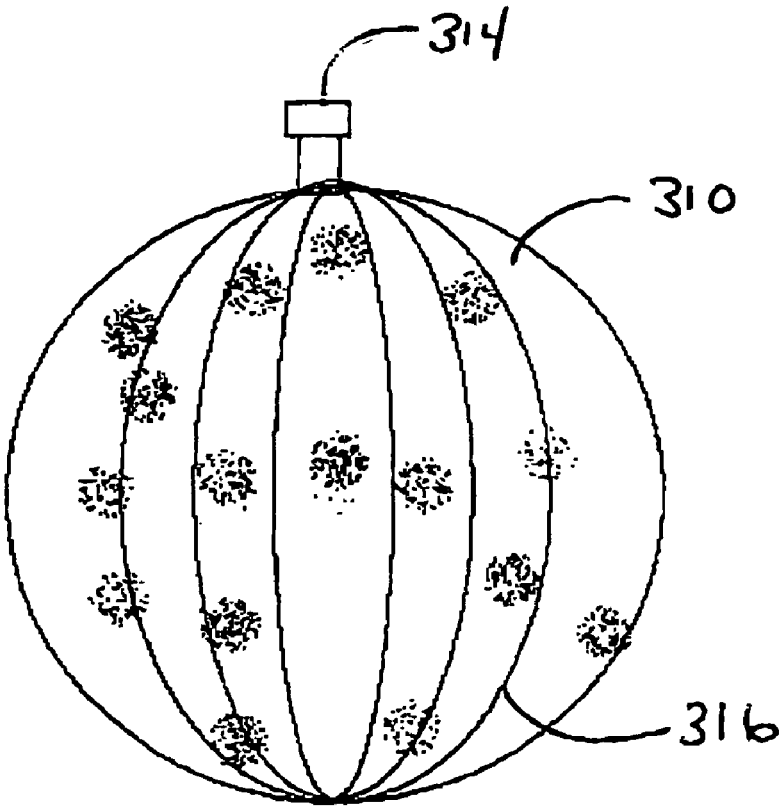
Figure 3d

822

APPARATUS FOR FACILITATING THE CONSTRUCTION OF A SNOW MAN/WOMAN

PRIORITY

This patent application claims priority to U.S. patent application Ser. No. 11/045,837 with a date of filing of Jan. 31, 2005, entitled "Apparatus For Facilitating The Construction Of A Snowman/Woman".

The following is not a joke patent. Its completely serious and is a serious undertaking to obtain a patent.

BACKGROUND

1. Field of the Invention

The invention relates to a toy or article of construction for constructing or building a Snow Man or Snow Woman.

2. Related Information

HISTORY OF THE SNOWMAN/WOMAN

The history of the snow man or snow woman is unknown. But, I have to say this. Whoever the first person was to think to form snow into a human figure was a genius. For untold years thereafter, children and adults alike have been thrilled and received joy in making and watching others make snowmen, err women. You know what I mean. At any rate, what is remarkable is that no one has ever thought, or at least reduced to practice, a way to make snow people easy and fun. I have done an abbreviated patent search and there is nothing relating to the subject of creating a snowman. Unbelievable since it is so much fun and considering the effort involved. But, if no one has thought of it, well, no one has thought of it.

Making a snow man is hard work. As an old pro, I know what a pain in the back it is to roll a snow boulder around a yard. As the snow boulder grows, it gets exponentially difficult. So if you want to make a real big snow man, like me, you wind up breaking your back.

If your like me, you enjoy building snow men . . . big. The bigger the better. One problem is there isn't always someone around to help. It is very difficult by yourself. Over the years, I have developed different tricks to assist my self-style of building snow people. My favourite trick is to use the long end of a shovel as a lever to rotate the boulder when it is really big. With this trick, you can keep rolling the boulder a precious few feet and get the boulder really big.

Another trick I have considered is to start rolling the snow ball on top of a hill or on a slope and work downward as the boulder gets bigger. Even though this works relatively well, it's still hard work to get the boulder to be really big. Besides this, you may wind up with an uncontrollable rolling snow avalanche.

But building a bigger boulder belies an even greater mischief. That is, getting the torso on top. Of course, you want the torso to be proportional to the oversized boulder you have already created, so the torso has to be fairly large as well. Now, the boulder is pretty heavy. Compacted snow is virtually like ice! And you have to lift the darn thing a good four feet. Now this is really back breaking.

Not to mention that now you have to put the head on top. All of this is pretty difficult even for an adult (or big kid) like myself. What is more, I really cannot build a bigger snow man than about my height. The boulder is just too heavy. Just consider how a kid, who would love to build a big snow man/woman, would have no chance without adult help.

I have tinkered with the concept of building a ramp in order to roll the torso boulder on top of the base boulder. I have tried to make a wooden ramp, but the wood proved to be too flimsy to hold the heavy weight. I then considered building the ramp out of snow. But the boulder is just too darn heavy and squooshes the snow down. And building such a ramp requires a lot of time, and snow, which you don't always have.

You never realized there were so many hurdles in building a snow man did you? Well, here is another. Getting the snow man/woman in the precise perfect place. Let's say you want the snow man right in front of the house door. Well, gravity has a lot to say about that. If your house, like most houses are built up to provide drainage, it becomes a serious physical effort, as well as logistical challenge, to roll the boulder to the right spot.

Another thing has always bothered me when I have built snow people. You can never make a perfect snow man. The snow balls are never, and I mean never, perfectly round. They are always lop-sided and look sort of doofy.

There is a construction problem, as well, related to the non-uniformity of the snow balls. Namely, it is difficult, particularly with large snow men, to balance another snow ball or boulder on top without it toppling over. To make matters worse, the third ball or boulder on top is made even more difficult to balance on a bust that is already tipsy.

Another problem in the art is that there is often not enough snow. With the first snow fall of the winter, ushers into each of us elatement and joy of running outside and playing in the snow. Unfortunately, all of this enthusiasm is lost on a lack of snow. The first snow fall usually never sticks. We can also drag in global warming here as a culprit for seemingly declining snow levels. But this patent attorney won't reach that far. The point is, wouldn't it be great if we could build a snow man of decent size with relatively less or little snow fall.

Lastly but not leastly, one must consider that the snow person is subjected to warmer temperatures and will melt. It will settle as the weight of its own snow compacts in on itself and deform, possible falling over. Adornments placed on the snow man will tend to loosen and fall out. Happy smiles fade into frowns. Eyes get droopy. Wind will blow away hats, scarves and other accoutrements. Finally, there is terminality. You have to do all of that back breaking work again if a warm snap comes by and melts your snow man.

Of course, all of the problems of making snow men/women is part of what makes it fun. Getting a whole group of people around and working together. Being outside in the snow for hours. And, yes, having a doofy lop-sided snow man does have some charm. And, even if you don't have enough snow, who cares anyway.

That may be true. But we are living in the 21$^{st}$ century now. We have created the Internet. China is getting ready to send a person to the moon. And we invented silly putty, perhaps one of the all-time greatest inventions a big kid ever invented. Can't somebody build a better snow man?

So then the flash of genius strikes me. What if? What if someone could make a snow boulder that was light weight. So light, it could be easily handled so that it could be made really big and still be easily moved, or even carried, even by a youngster. A snow boulder light enough to be easily placed on top of another boulder. Or light enough even to be easily positioned in that perfect place in your yard?

What if someone could make a snow boulder that was perfectly symmetrical, so that it could easily balance on top of another similar boulder. A symmetrical boulder that could form a perfect looking snow man? How cool would that look in front of your house during the holidays?

What if someone could make a snow boulder that is perfect every time. A snow man that could be replicated so that it looks the same each time, each year. Or rebuilt from the old snow man/woman in a matter of moments.

What if someone could make that out of a light weight, abundant material that is cheap and is practically used in all toys?

What if a really big snow man could be built utilizing the bare minimum of snow?

What if?

Today is that day.

SUMMARY AND OBJECTS OF THE INVENTION

It is said that the most ingenius ideas are the most simple in design. The Wheel. The Toaster oven. And, yes, now the ultimate Snow Man. Of course, in hindsight the wheel is not so inventive, but at the time it was an earth-shattering innovation. I do not pretend that the ultimate Snow Man will be as revolutionary to the advancement of mankind, but I do contend that as far as I know no one has ever conceived and reduced to practice such an apparatus. I do contend, however, that my innovation is a heck more fun, err than a plain old wheel, and will inspire tons of enjoyment and play for hopefully a long time.

The fundamental building "block", or component, of the invention is the creation, for the first time, of a snow sphere that is much lighter in weight than a snow ball or boulder of the same size made out of snow. The snow sphere is made of a material that is rigid enough to support a layer of snow, yet made of a material or construction that causes the snow sphere to be much lighter in weight than a snow boulder of similar size. The Snow Sphere preferably includes a snow adherent surface that is amenable to bearing and holding snow particularly for varying conditions of snow from dry to wet.

The snow sphere should be of a material that is capable or suitable of supporting a layer of snow. It should also be of a material that does not soften when exposed to water. That is, cardboard would likely be a poor choice of material, whereas rubber or plastic would be more suitable for this purpose.

In one aspect, the interior of the snow sphere, thus encased in a layer or sheath of snow, is hollow or substantially hollow. For this reason, it is much lighter and, thus, much easier to handle than a snow boulder of the same size comprised entirely of snow.

Further, given the spherical shape of the Snow Sphere, the snow formed on the adhesive surface forms a shell that reinforces and, indeed, provides its own support and rigidity. In another aspect, or in combination therewith, the Snow Sphere includes supporting structure on the inside, such as spokes, ribs or Styrofoam.

The invention further encompasses the construction or assembly of such spheres, a number of such snow spheres as well as the assembly of such spheres. There is also provided a manner to adjoin the boulders together. There are also attachments and means for attachment for the invention for body members or decorative objects.

From the above, it shall be appreciated that the present invention provides an elegant solution to the age old problem of snow man/woman building technology. Using the present invention, one can much more easily manipulate one or more of the Snow Spheres in order to roll, position and assemble a snow man/woman. Certainly, this provides an enormous advantage over the prior method of hefting large, snow compacted, boulders atop another. Kids all over the world will be able to easily and quickly build snow men/women adding immensely to the enjoyment and fun of the art.

Because the invention forms near perfect spheres, there is also the advantage that beautiful well dimensioned and proportional snow people can be built. Usually, only lop-sided and imperfect snow people could be achieved in the past. Snow men/women perfectly formed may also be appealing for business displays or holiday decoration in front of official buildings. However, we shall leave the business method aspect of this invention for the next patent application.

It has further been determined that dry snow sticks less well than wet snow. The proposed solution also seeks to provide a snow sphere that accumulates snow well in most or all snow conditions, namely both wet and dry snow. To that end, research and testing have been performed on the various types of snow and why these different types stick. Avalanche, snow and ski technology were consulted.

The type of snow is one factor that determines the "stickiness" of the snow. Age, temperature and altitude also are contributors. To better understand why snow sticks, the known technology on types of snow were consulted. A key factor is the water factor of the snow. Too little water and the snow is too dry to combine. Too much and you have slush, not snow. Shape is another factor. Snow flakes formed under the right conditions cluster. Morphed snow that melts and reforms into granules combine less well or not at all.

The proposed solution further includes manipulating the snow to increase its stickiness. For example, heating the snow will cause it to have a higher water content. The heating may be caused by artificial stimulus such as pressing the snow sphere against the snow to cause it to melt, at which point it has better gripping characteristics. By providing a hard enough shell, the proposed solution allows the snow to be pressed sufficiently to cause it to morph back into a stickier form.

However, truly dry snow has proven during tests to be more difficult to pick up. Hence, another hurdle is to provide a snow sphere that has good adherence qualities not only for wet snow but also for dry granular snow.

In my research, of ski and snow boarding technology, I came across an interesting fact. Dominator Race Wax, Inc., of New York, US, reports that electrostatic friction is a factor that contributes to skis and snowboards being slower in dry snow conditions. According to their web site, "electrostatic friction [friction caused by objects having two different electric charges] is poorly understood and often ignored, even by many wax companies. In the last years, some groundbreaking work began to shed light on this subject. It has been discovered that static electricity can increase the friction of polyethylene (the base) on ice by 65% and the friction of metal (the edges) on ice by 40%, so clearly the elimination of static electricity is critical to achieving high speed."

And I thought . . . hmmm . . .

Static is evidently a bad thing. Everyone knows about getting an electric shock in the winter or the 80's bugaboo of destroying a computer's RAM chip. Static is also bad for skiing. Evidently, as the skis brush the snow, particularly crusty dry snow, the skis take on a non-neutral charge. The neutral or charged snow, particularly caused in dry atmosphere conditions, "grabs" the passing skis. Yep. Static is bad with a capital "B".

While the rest of the world seems to be concerned with eliminating static, the proposed solution here thus considers employing static electricity to attract and hold dry snow to the snow sphere. Instead of seeking ways to make snow less sticky, as in the Ski art, the proposed solution here seeks to make snow more sticky.

According to several articles, Burrows, D. A., and P. V. Hobbs, Electrical charges on snow particles, *J. Geophys.*

*Res.,* 75, 4499-4505, 1970, the Lenard effect causes individual airborne snow particles to be distributed approximately symmetrically between positive and negative values. The majority of the small charges were negative, however, and the majority of the large charges were positive. He further reports that newly formed provides a large number of positively charged particles. In fact, Magono, C., and K. Kikuchi, On the positive electrification of snow crystals in the process of their melting (II), J. Meteorol. Soc. Japan, 43, 331-342, 1965, indicate that melting snow turns to a positive charge as the air bubbles in the melting snow are released and carry off a negative charge. In any event, it is also known that static charges dissipate over time. Hence, snow lying on the ground is theorized to have a positive or neutral charge.

All this means that snow, particularly granular dry snow can carry a static charge. Very exciting stuff indeed. So I went and bought myself a nice hard plastic ball. In my living room I ripped up some bits of paper to simulate the old comb and paper static trick. Rubbing the ball on my sweater vigorously, I then placed the ball in the vicinity of the torn paper. Holding my breath, I saw what I knew had to happen. The paper of course "jumped" to the plastic sphere.

I next took some sand, which is glass silicon of course, a natural isolator and perfect for this experiment. I replicated my sphere on wool sweater trick, this time placing the sphere close to the sand particles. To my wondrous surprise, the sand leaped instantly onto the sphere just like little iron balls to a magnet. Of course, some of the sand particles, upon being charged by the sphere were immediately repelled. However, a substantial quantity of sand stuck. I was very amazed at how well and strong the force was to make sand particles leap a good inch and a half. A grain of snow should not be much heavier than a grain of sand. And I thought . . . uh-huh.

Now. I went outside and found a good source of granulated snow particles. Don't forget, granulated dry snow is also an insulator like sand. Again I duplicated my experiment. Wool sweater . . . rub sphere vigorously . . . place sphere near snow . . . hold breath . . . AND. Well, the static charge didn't work as well as I hoped. But it did work! I had to place the sphere close to the snow, and some particles did cling on. Hence, proving my hunch. Snow can be manipulated by a static charge.

I never could have imagined that snow was sensitive to static electricity.

I theorize that, in my experiment, either the snow was not dry enough (thereby not providing good insular characteristics for static build up) or the charge on my ball was not strong enough. At any rate, it seems that the basic concept works well enough to support a working invention. I conclude that a strong enough charge would attract more snow particles.

The proposed invention provides a charged snow sphere, which may be negative if plastic, that will attract the positively or neutrally charged snow. It may also be charged positive to attract positively charged snow. This may also be combined with a textured surface of the snow surface, which has a combined effect of adhering wet snow as well as dry snow.

In a further embodiment of the invention, there is provided a means for generating a static charge on the outer surface of the sphere that is incorporated with the sphere. Preferably, to provide a smooth rolling surface, the means for generating the static charge is incorporated within the sphere. Aha, sounds really patentable doesn't it? This variant may be combined with the adhering surface.

In one aspect, the generator is a Van der Graaf generator that is disposed inside the sphere. I've done some research and a Van der Graaf generator can be built as small as a soda can. In another, the generator is a dielectric connected to an energy source, whereby the dielectric stores a charge that attracts the charged snow particles. In one aspect the dielectric is formed by a conductive layer on the surface of the sphere covered by a thin non-conductive layer. An access panel mounted in the wall of the sphere and made to be continuous therewith allows the user to access the generator or switch thereof that switches on the generator.

In a further aspect, there is provided a control device for regulating the maximum charge capable of being formed by the generator. It would not do to zap little kiddies. I am sure it would not harm them, but I am thinking of greedy product liability attorneys.

So there it is. My new and improved method and apparatus for building a snow man (woman). OK. Snow woman (man). There.

BRIEF DESCRIPTION OF THE DRAWINGS

FIG. 2*a* illustrate the present invention;

FIGS. 2*b-d* illustrate an adhesion surface of the present invention;

FIGS. 3*c-d* illustrate a variant of the invention;

DETAILED DESCRIPTION OF THE PREFERRED EMBODIMENTS

Figure 1:
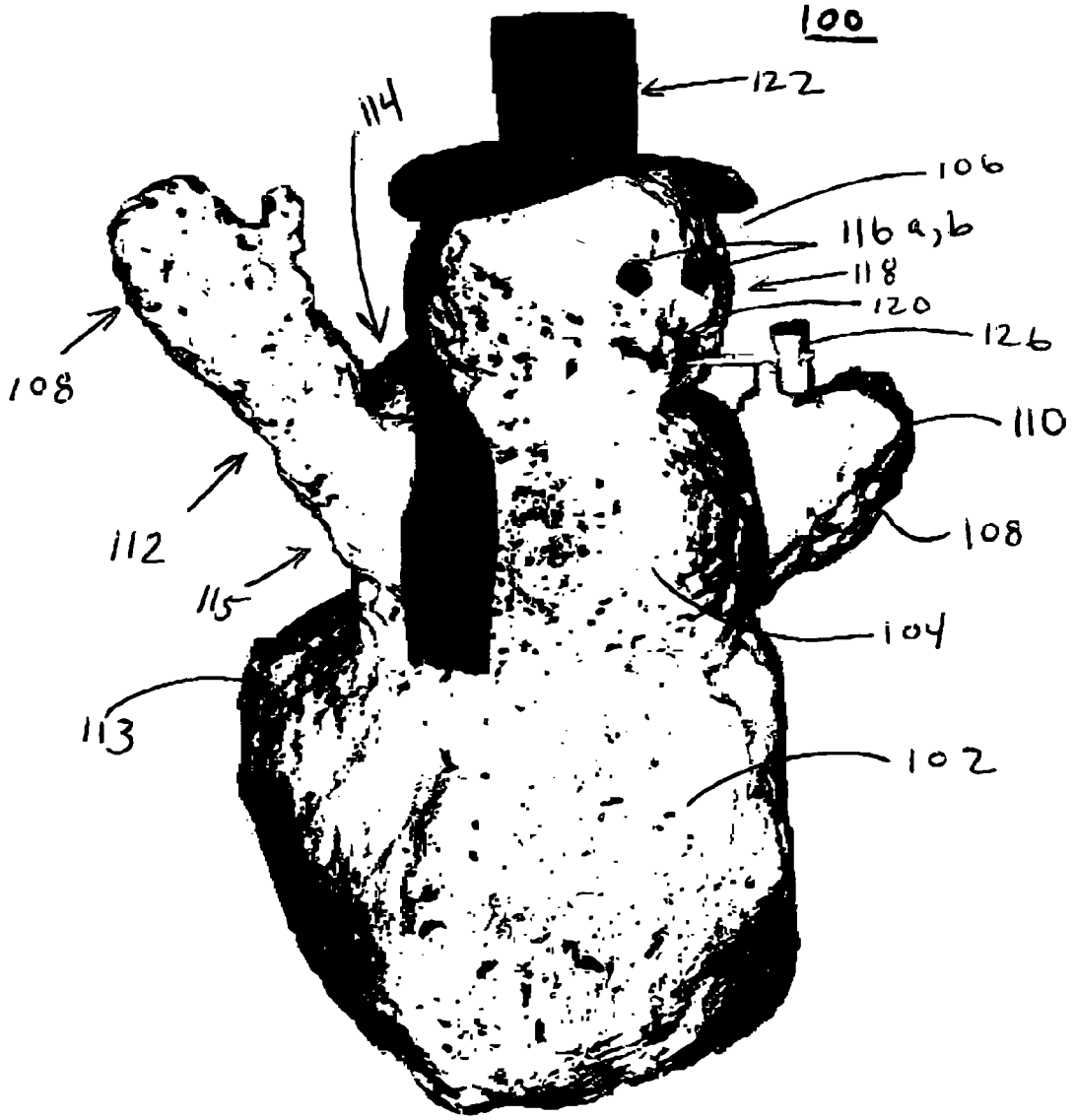
FIG. 1 illustrates a snow man.

To gain a better appreciation of the task at hand, we turn our attention to FIG. 1 which illustrates the good old fashioned snow man 100. But I shouldn't say its good old fashioned, because I used some proprietary techniques to build it. Before we go there, however, let's examine this snow man in more detail.

I made this snow man all by myself. It stands about 6 feet high without the hat and comprises three snow boulders 102, 104 and 106 which we shall call the trunk, or base, 102 the torso 104 and the head 106. There are also arms 108, a feature I am somewhat proud of. Notice the realistic mitten shape 110 of the gloves. Although it is arguable that kids across the globe make arms out of twigs, icicles or even branches encased in snow, I think one can say that I have advanced the art here. I received a lot of compliments on my snow man. For all that, there are problems.

First of all, you will notice that our snow man, which I shall refer to as Frosty, has quite a large caboose 113 on his trunk 102. In less politically correct terms, his behind is quite large. This is the result of not being able to roll the snow ball evenly. In fact, to obtain such a spherical shape is quite impossible. As the snow boulder grows in size, it tends to form unevenly. I believe this is due, in part, to the varying density of the snow on the ground.

The same can be seen with smaller boulders, such as the torso 104. Here, Frosty apparently seems to be suffering from Hunchback of Notre Dame Syndrome 114. What hump? I suppose these irregularities could be eliminated if one were so careful to roll the ball perfectly in every direction. However, that would require perfect and uniform snow conditions. At any rate, it would take ages to adjust the boulder as it rolls to the perfect side so that the ball is nice and spherical. Not fun.

I know what you are thinking. Why not just lop off the uneven portions. I tried this. It's not so easy on compacted snow. Also, it changes the balance of the snow man. If you lop off a large section, you seriously jeopardize the balance of the snow man. In doing so, you could knock your snow man right over. Particularly as the snow melts, the snow man will slump to one side, again possibly falling over.

On the positive side, the arms in FIG. 1 illustrate just how creative one can get with a snow man like Frosty (or snow woman, which we will later refer to as Angel). I am quite proud of these arms. My secret is to pre-place holes in the side of the torso 104 using a branch or, in the instant case, a long board. Then, I remove the board and compact snow around the board to form a snow arm. I then mold snow hands in the shape of mittens. I leave a little extra of the board sticking out that will be placed in the pre-pared slot.

I then build up snow shoulders, not only for aesthetic appeal and anatomical correctness, but also for support of the arm. One must consider longevity. Frosty will melt and the arms will sag if left unsupported. I also try to support the weight of the snow arms by shoving the board as far down into the trunk 102 as far as possible. Thereby gaining leverage and support from the trunk 102 and lowering the center of gravity of the arms.

As great as these arms are, however, there are several problems with my previous constructions. First, you will notice that the shoulders can never be in the anatomically correct position. Instead, they are formed at a middle point 112 of the torso 104. This is apparently due to the fact that the torso 104 cannot support the heavy weight of such snow arms at a relatively higher load, say at point 115. It looks stupid.

There is another fault here that needs to be pointed out. Normally, the arms must be placed on either side of the snow person at relatively opposite positions. This is due to the fact that the uneven placement of the snow arms at different corresponding positions causes the torso to tilt, particularly as the snow man melts and loses cohesion.

Another problem is apparent from this figure. Frosty appears to have measles. A really bad case. These are actually crab apples that stuck to the snow boulders as they rolled. Apparently, the larger the boulder, the more it's weight presses down and compacts the snow as it rolls. With extremely heavy boulders like this one, and given light snow conditions, the weight compacts the snow enough to pick up bits of earth, grass, and yes crab apples.

A final word here is due on Frosty's features. He has two eyes 116 *a, b* (not coal) and a mouth 118 made out of some stones. One particular problem, on such a warm day as it was, was that the stones kept falling out. Cold stones seem to have terrible adhesion with snow. You can see here that Frosty is missing his two front teeth 120. Further, Frosty sports some additional props, a top hat 122, a scarf 124 and a pipe 126. As any kid can tell you, the problem is that a good wind will blow that hat 122 right off. The scarf 124 is more resistant to being blown off by the wind, but it definitely did flop over to one side and had to be re-positioned later. The pipe 126 seems to be quite secure as it has a long distal end that is shoved into Frosty's mouth. We want to ensure Frosty's lip cancer. But, in actuality the pipe 126 kept falling out as the snow melted. Frosty new better.

Needless to say, despite the fact that it is January it has warmed up since then and Frosty is now "awl melty" and "gawwn". Gee whiz. Even though this snow man only took me 2 hours (I worked really quickly), it was tiring and exhausting work even for an expert like myself. Now I have to start all over again.

Enter the ultimate Snow Man. The present invention provides a unique manner in which to build or construct a snow man or woman and a method therefor.

More particularly, there is provided the building blocks and method to provide and assemble the building blocks for creating the ideal snow man/woman. What is invented is the ability to create snow boulders that are light weight and, therefore, more easily handled and lifted atop other such boulders. With this invention, the ideal snow man/woman can be created anywhere, with much less effort than before and without long hours in the cold.

In this invention, a snow man or woman may be as little as two snow balls or boulders. Of course the traditional number of snow boulders for a snow person is three, and naturally the invention encompasses three boulders. That said, the invention encompasses more than three snow boulders. At any rate, we shall focus here on the fundamental building block of the invention, a single snow sphere. Such a snow sphere could be utilized, for example, as a torso or head on top of a normal snow boulder.

FIG. 2*a* shows the fundamental building block of the invention, the Snow Sphere 200. The Snow Sphere 200 is a sphere or sphere like shape generally in shape of a sphere. Naturally, the snow sphere is sphere shaped so that it may be rolled easily in any direction, thereby attaining the ideal spherical snow boulder. The spherical shape also provides the builder with ease of maneuverability and handling of the snow boulder.

The dimensions of the Snow Sphere shall not be limiting of the invention. That is, the Snow Sphere may be of any size. However, in one aspect of the invention, the snow sphere or spheres are proportional to the size of the size of a normal man, woman or child which they emulate. In other words, a diameter 202 for trunk snow sphere in this aspect for an adult snow person would be the height of a normal adult up to the area of the hips. A child trunk would be proportionally smaller, naturally. Similarly, the torso diameter for an adult is about the same length of a torso of a normal adult. Of course, the range of sizes varies with the variety and range of human sizes.

The Head is another matter. While the head may be of any size, it is typically in proportion with the trunk and torso. See for example FIG. 1. In this variant, therefore, the diameter of the head snow sphere is proportional to the other snow sphere or spheres. Again, the head, torso and trunk may be of any size. For example, it is an advantage of the invention to create larger than life snow men/women and, therefore, the proportions of the invention may be larger than normal. FIG. 2*a* also illustrates another variant of the invention. The adhesive surface 204. The function of the adhesive surface is to provide a grippable region where snow can more easily clump and form within the pockets between elements forming the adhesive surface. Test trials have been performed and have proven that it is much easier to apply the snow to the Snow Sphere 200 with the adhesive surface than to a sphere with smooth surface. In the latter case, the snow tends to slide off one side of the smooth sphere, particularly when rolled. In the alternative, the adhesive surface holds clumps of snow in place on the Snow Sphere whilst the builder scoops up more snow and applies another clump to another region. The adhesion surface is designed to include a substantially higher friction coefficient than a smooth surface, that is sufficient to grip or hold snow thereon.

In operation, the snow sphere is rolled to attract snow on a side of the snow sphere that is in engagement with the snow and, by action of the user pressing substantially on the opposite side thereof, the pressure which is transferred to the engaging side causes the snow particles to be picked up by the adhering surface by action of the nodules/holes thereon, the pressure causing the snow to partially melt and stick to the nodules/holes or a combination of both.

In this aspect, it is quite convenient that the builder does not have to stoop down and apply the snow manually to the snow man. The builder continues to roll the snow sphere about its x-y-z axes, in each direction, and by substantially each degree of axes x, y and z until the snow sphere is covered in at least a layer of snow. If it is chosen to apply more layers, this first layer provides an outer surface of stickiness for all other layers. Thus, as already mentioned, the snow sphere for use in this embodiment should be of a suitable strength, that is cross-sectional strength to withstand pressure from a builder pressing down, and even perhaps leaning on the snow sphere, from above.

In testing prototypes, it was discovered that the sphere shape has a previously unrealized advantage. It appears that when a roller is used, which has a cylindrical shape, a second or third rolling of the roller causes snow to peel off the roller. It took some effort to cause the roller to be completely covered. The sphere, on the other hand, allows a rolling of the sphere to contact one general area of the snow sphere, thus avoiding multiple rollings and the peeling effect of the snow. Once the snow sphere is completely covered, the snow in adjacent areas support each other and do not come off, i.e., peel, from the snow sphere.

Once the Snow Sphere 200 is encased in a layer of snow, the builder simply rolls the sphere on the snow to build up more snow on the Snow Sphere. The snow on the Snow Sphere has proven to grip well with snow on the ground. Because the Snow Sphere is large to begin with, it is already quite sizeable with this first layer of snow manually applied by the user. With the added weight of the first layer of snow, the Snow Sphere has proven to be able to have enough weight to compact snow underneath it as it rolls and collect even more snow. Of course, the Snow Sphere itself is much lighter than it would have been if it were composed entirely of snow.

The adhesive surface has another function. As the snow melts, it tends to slide off an adhesion surface less readily than a smooth surface. This allows the ultimate Snow Man to last longer and require less maintenance.

The snow sphere in one variant is white in order to hide any lapses in snow. This is particularly useful when the snow melts, leaving behind patches of the snow sphere surface exposed. In another variant the snow sphere is colored, such as red or orange, in order to highlight places to the builder which require more snow. A black surface has also been experimented with. It appears that the black surface warms quicker in the sun which tends to be better for gripping dry snow. Evidently, the warm surface of the snow sphere melts the first layers of snow it comes into contact with, providing the crucial dampness needed for snow clumping.

Now we turn to the composition of the snow sphere. The snow sphere may be constructed out of any material that is suitable for holding its shape under the weight of the first layer of snow. On the other hand, the material need not be so rigid or thick as the snow itself will form the supporting structure once the snow sphere get rolling. While this is not an exhaustive list, the show sphere may be, for example, made out of plastic, graphite or any other composite, fibreglass, aluminium or any other metal. As long as the material is strong enough to support the snow sphere structure and the first snow layer, the material is acceptable.

FIG. 2*b* illustrates a variant of the adhesive surface. Here the adhesive surface is comprised of nodules 206. Here the nodules are shown as trapezoidal shaped protrusions, or studs (square or otherwise), extending from the surface of the snow. In one variant, the protrusions have a top surface 208*a* that is smaller than its base surface 208*b*. This is easier for molding the snow sphere. However, the invention also encompasses the surface area of the top of the nodules to be larger than the base (reference numeral 210), thereby trapping the snow 212 like pores in between the open areas near the base of the nodules as shown in FIG. 2*c*.

There are a number of parameters of the nodules that effect adhesion. There are at least shape of the nodule, size and spacing between the nodules which is important. In addition, the placement with respect to other nodules and texture of the nodule itself are other parameters that are important to adhesion.

These shapes have been experimented with and by this inventor and the result of this experimentation will be set forth below. In another variant, the nodules may be in the shape of crosses or C or L-shaped. The nodules may be small balls, an advantage of which is that the snow captured between and under the balls. A pattern forming a rough surface was also tested, such as a matrix formed of glue or silicon rubber.

Another variant experimented with is the nodule with a depression or snow receiving hole. Any of the shapes mentioned here may include such a depression. Although, squares and cylinders, in the shape or tubillinni pastas, as well as crosses with depressions was experimented with. It was found through my experimentation that the gripping effect of nodules with depressions improved the adhesion capability of the nodules. In particular, the snow is forced into the depressions (or holes) by the acting force of the snow sphere rolled or pushed down onto the snow. These depressions act to provide more grip to the snow and tend to "pick up" the snow well, allowing the snow sphere to be rolled and consequently be encased in a layer of snow.

Another variant on the mesh concept described above is the use of a screen or mesh that is elevated above the outer surface of the snow sphere by, for example, small posts between the mesh and the outer surface. The mesh may be rigidly fixed to the outer surface to form a small area between the outer surface and the mesh where snow enters the opening in the mesh and becomes trapped. The snow trapped in the mesh does two things. First, it forms a layer of snow that additionally assists in adhering snow to the outer surface of the snow sphere. Second, it provides a cold surface for the snow sphere.

It was assumed that pressure and heat causes the snow sphere to adhere snow better. To some extent this is true. But for some types of snow, particularly grainy snow, it was experimented and it was found that a lighter rolling of the snow sphere produced better results. A heavier roll caused the snow to compact into the ground and stay on the ground. While the texture of the snow sphere made an imprint that was appealing, it did not adhere to the snow sphere. On the other hand, in some instances, a lighter rolling of the ball yielded a higher adhesion of snow.

It was also assumed that a warm snow sphere would be better at attracting snow. However, in testing it seemed that, at least for dry snow a cold surface attracted the snow better. It is hypothesized that, much like the bottom of a ski that rubs against snow, a thin layer of water is formed on the surface of the snow sphere that causes the snow to slide off. In contrast, this implies that a material or surface that is cooled quickly or maintained cold would have better adhering properties. For example, any of the textures that attract snow, such as the mesh variant above, that cool the surface of the snow sphere would maintain a cool surface more capable of attracting snow particles.

An alternative to a mesh suspended above the surface is to cover the snow sphere with steel wool, the locks of the wool trapping snow flakes and particles within. Further rolling the snow sphere hence adheres more snow to the already caught snow in the wool.

Other textures are also suitable for use as the adhesion surface. These other textures may have varying degrees of grip to the snow dependent on the type of snow. For example, the larger nodules have proven to be not as effective for dry snow. A sand paper adhesion surface has been experimented with and it appears that the smaller nodules of the gritty sand paper are slightly better for relatively dry snow. Of course, the invention encompasses any of these shapes or nodule forms or combinations thereof.

Other shapes for the nodules are within the scope of the invention as well. For example, in order to prevent injury to children, the nodules may be in the form of bumps. Depressions, such as round or square-peg holes may also be applied. Golf ball dimples could also be used. In that case, the depression of the dimples provide the area where the snow is compressed and sticks to the surface of the Snow Sphere. The nodules may be, for example, replaced by holes bored through the shell of the snow sphere itself.

The nodules, studs or depression do not necessarily have to be uniformly spaced over the entire surface of the snow sphere. Although, this would tend to add to the uniformity of the snow layer stuck to the outer surface of the snow sphere. In addition, it would be easier for a plastic mold to be constructed with evenly spaced depressions for the nodules. It is sufficient that the nodules should cover substantially the entire snow sphere so that the entire snow sphere may be applied or roll-covered, that is rolled and snow adhering thereto, in snow.

Experimentation with a prototype snow sphere has revealed that certain materials may be preferable over others. It has been found through experimentation of this inventor, for example, that a soft rubber or elastic material yields to a pressure exerted on the adhesion surface such that a unit of the adhesion surface, such as a stud or other protrusion, will be forced into the surface of the snow sphere upon pressure contact with snow on the ground.

The effect of ground pressure on an elastic surface is shown in FIG. 2*d* wherein a cross section 214 of the surface of the snow sphere is shown. Here along the surface is an adhesion unit 216, here shown as a square peg. The function of the adhesion unit 216 is to form a adhesible surface so that when a child rolls the snow sphere on a snow covered surface, that the pressure applied by the child causes the adhesion surface to adhere the snow to the snow sphere. Here, however, when the snow sphere surface is comprised of an elastic material, the pressure (X) 218 caused by the snow against the adhesion unit 214 causes the adhesion unit to recede or be pressed into the surface of the snow sphere. As a result, the deformation 220 of the snow sphere surface reduces its ability to grip and "pick up" snow.

A rigid material, such as hard plastic, has been tested and it was determined that the rigid material resists an impinging force, namely the pressure exerted on the surface of the snow sphere when rolled on the ground against a snow surface. What is meant by rigid, is a material that withstands a shearing force without significantly deforming, such that the adhesion factor of the adhesion surface is not significantly reduced.

Of course, this is not to say that rubber is excluded from the invention. Perhaps a hard enough rubber material or compound is used, or perhaps, when the rubber is sufficiently cold as when in the cold outdoors, the rubber is stiff enough to avoid being deformed. Also, and as described below, an internal structure, such as Styrofoam injected into the interior of the snow sphere may reinforce an elastic surface in order that it does not deform significantly under an impinging pressure. As discussed below, a balloon type of snow sphere with an artificial foam injected therein by the user is one possibility. Furthermore, a hard enough styrofoam ball is also suitable.

More research on the matter has revealed that various types of snow have different stickiness. Wet snow has a much higher potential of forming a snow ball than dry snow. The various forms of snow are discussed above in the background section. The solution here proposes to provide a toy for all types of snow, wet or dry, so that a snow person can be built with any (or significantly most) type(s) of snow.

As for spacing of the nodules with respect to another, it was found through experimentation that offsetting the nodules works well as it provides more of a gripping effect than when the nodules are spaced uniformly and side by side.

The size of the nodules was experimented with. As mentioned, sand paper was applied to a snow sphere. This work better for gritty snow. But it had poor gripping qualities when rolled. For all around purposes, that is both wet and semi-dry snow, I found using small stones with a width of about 2-5 mm, (glued) dispersed more or less continuously over the sphere, to work well for varying conditions. It would also seem that holes or nodules of this size would work well. I found the larger nodules not to be able to grasp dryer snow as well. I predict that these larger sizes would be fine for sticky snow.

The spacing between the nodules also seemed to play a role. Too wide spacing meant that the snow doesn't get caught in between the nodules. Too little and there is not enough room to allow the snow to be caught. Similar to the size of the nodules, the spacing seemed to be of similar dimension, i.e., 2-5 mm.

From the experiments, it seems that nodules that have a significantly smaller surface area at the impinging surface of the nodule as compared with the base, namely nipples or spike-like protrusions aren't working as well. This suggests that nodules with a side that is substantially vertical or reverse-inclined works well. However, the embodiment using small stones worked well as well.

In assessing the material of the nodules, various materials were tried, including wood, cloth, plastic and rubber. Although all of these materials are within the invention, some materials proved better than others for snow with low stickiness factor. It was determined that the elastic nodules gave too much give and did not adhere snow as well. Cloth seemed to not stick to snow as well either. Wood for some reason was not a big winner either. Perhaps this has something to do with wood being a good temperature insulator and hence does not become cold enough to cause snow to stick to it.

On the other hand, hard materials such as plastic and metal performed the best. Plastic, or fiber glass, in particular might be overall the best since it seemed to get cold more quickly and is rigid. Plastic is also a static charge bearing material, which as described above, is a variant of the proposal to be combined with the adhering surface.

Forming the snow sphere of a rough, as opposed to smooth, surface to increase adhesion was also tested. With wet and dry snow, it was clear before testing that a surface having a texture would lift the snow particles more easily. However, the dry snow also adhered to the smooth surface that was applied with a static charge. Therefore, the invention includes an adhesion surface, that is smooth, but adheres snow by action of the attraction of the snow from the static electricity.

An appropriate size of the snow sphere was also considered during experimentation and it was concluded that an appropriate size should take into account handling of the snow sphere by both an adult and child of suitable age, around 5 years old, combined with the ability to form suitably sized snow balls by use of the apparatus. That is, the snow sphere should not be too wieldy to handle but large enough so that a builder does not have to bend down too far and, in ergonomic terms, can be rolled by placing weight of the builder on the sphere in a comfortable leaning position with the wasit bent on the sphere and the arms spread on either side of the top of the sphere.

For a child, it would make sense to provide a snow sphere about the size of an NBA basketball or soccer ball. This may be considered a minimum size for range purposes but is not necessarily exclusive of smaller sizes.

On the other end of the spectrum, the correct size seems to be a sphere standing at about the knees to waist of an adult, about four feet in diameter. Again, this is not a fixed upper range, but one which would be preferred for handling and the ability to make suitably sized snow boulders.

A comfortable size for both child and adult would be approximately 2-3 feet in diameter. These sizes appear to provide a snow sphere that is easily handeable but also delivers a good size snow boulder. Too small a snow sphere and it would just be as easy to roll a ball manually. Also such a small sphere would not impart much of a weight advantage for apply leverage to the underside of the sphere for compressing snow onto the snow sphere.

Figure 3A:
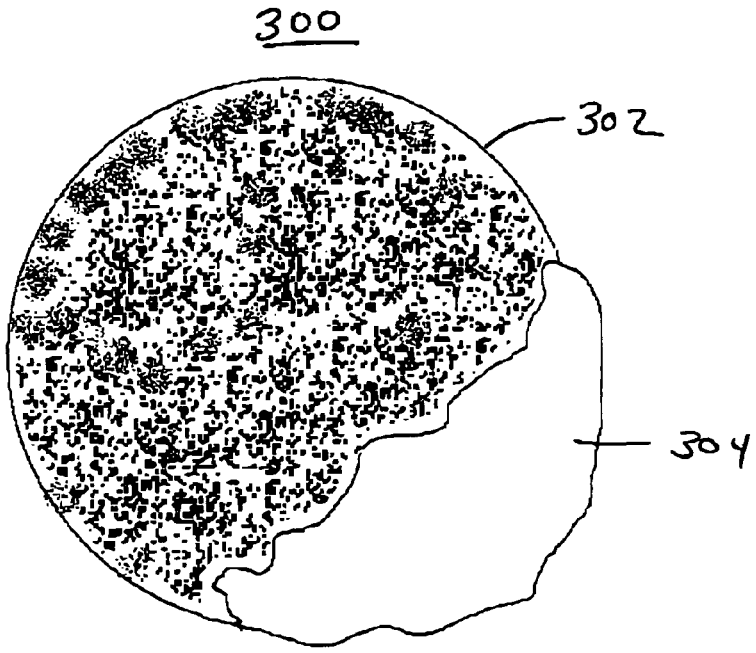
FIGS. 3*a-b* illustrate the invention in operation.

The clumping effect of the adhesion surface 302 of the snow sphere 300 is illustrated in FIG. 3*a*. Here, there is shown snow 304 manually stuck to a portion of the snow sphere. As explained before, the adhesion surface holds the snow 304 in place, making it easier for the builder to add more clumps of snow. Of course, the adhesion surface keeps the snow adhered to the surface of the snow sphere while it is being rolled or in its stationary position.

Figure 3B:
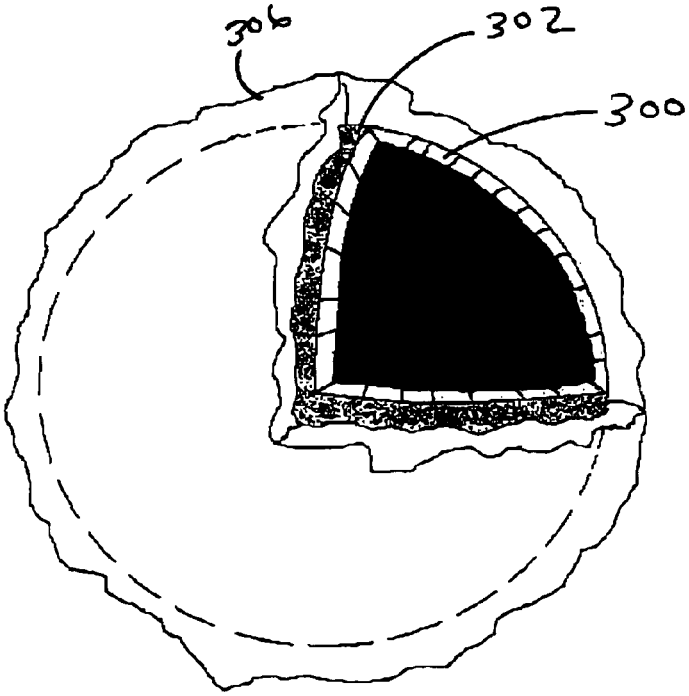

A phantom view of the snow sphere 300 that is completely covered in a first layer of snow or sheath 306 is shown in FIG. 3*b*. Except for the phantom portion removed for purposes of illustration, the snow sphere of the present invention is completely covered in snow. From this figure, it will be clear the massive savings of weight that is attained with the present invention. The snow is only on the outer surface and the entire inside of the snow sphere is hollow, substantially hollow, or made of a material that is of much less weight than compacted snow.

The result is a large snow boulder that is much lighter than a boulder of the same size. The resulting snow boulder of the present invention is, therefore, more easily manipulated and hefted than its primitive predecessor. It also has the advantage that it can be made even larger than normal, since it can be rolled much more easily than a boulder of the same size entirely made of snow.

FIG. 3*b* also illustrates a structural feature of the invention. The sphere or sphere-like shape is imparted to the snow covering the snow sphere. A physical characteristic of a sphere shape is that any point on the sphere is supported through adjacent points to all portions of the sphere. Thus, the snow itself obtains strength and supports itself once it is applied sufficiently to the surface of the snow sphere.

It should also be apparent from the figures that the show sphere is intended to be a unitary work piece. That is, it is not intended to be manufactured or sold as a composition of other pieces. That is, the snow sphere is, without first being rolled or covered in snow and placed on top of another snow sphere, free and unconnected from other work pieces. Of course, the snow sphere may be comprised of portions, such as hemispheres, but it is contemplated that the portions placed together form the unitary work piece. Later, a mechanism for adjoining the sphere to another sphere is contemplated, but this is added for the purpose of adjoining the snow spheres after they are rolled, or covered, in snow.

Another advantage of the use of snow hemispheres is that the snow sphere can be broken down into a storable and easily packaged product by placing one hemisphere inside the other. This is convenient for the user for storing during the summer or non-use. Another feature of the invention is that the snow sphere forms a storage container when not in use.

In one aspect of the solution, storage compartments are formed between the ribs of the snow sphere. The ribs may be formed in one hemisphere in order to accommodate storing items, clothes or toys, etc. The other hemisphere is formed empty in order that the first hemisphere may be placed therein. There is provided in addition a stand, such as a ring, such that when the hemispheres, one inside the other, are placed on the stand they form a storage container.

Another possibility, shown in FIGS. 3*c* and 3*d*, is that the snow sphere is a blow up sphere or beach ball with the adhering bearing surface. Shown in the FIG. 3*c* is the balloon 308 relatively deflated and the snow sphere balloon 310 inflated. The balloon may be blown up through a mouth piece 312 or inflating valve 314 opening that may be closed with a plug or valve cover as is well known in the art of blow toys.

A blow up snow sphere has the advantage that the owner can store the snow sphere easily. It also makes stocking of the item and display in stores much easier. Also, the compressed air inside the balloon snow sphere adds to the support of the structure. The balloon is also much lighter in weight. The main concept is the same. The builder applies the snow clumps to the adhesive surface 316 and then rolls the snow sphere to create a large snow boulder that is lighter in weight than a normal snow boulder.

Figure 4A:
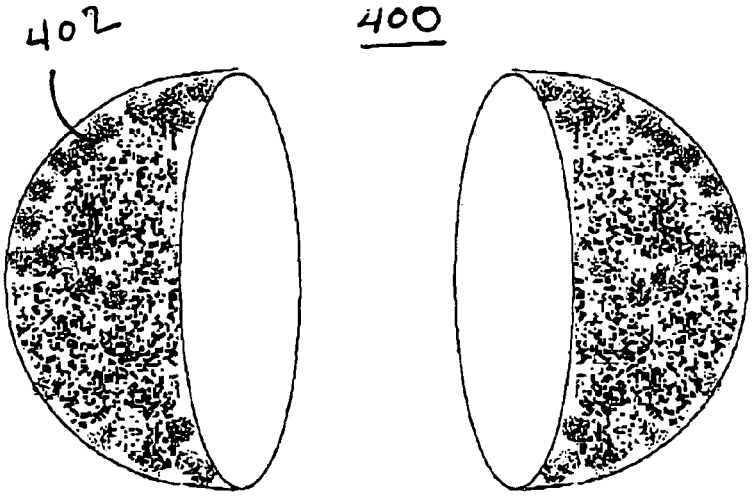
FIGS. 4*a-c* illustrate an interior of the invention.
Figure 4B:
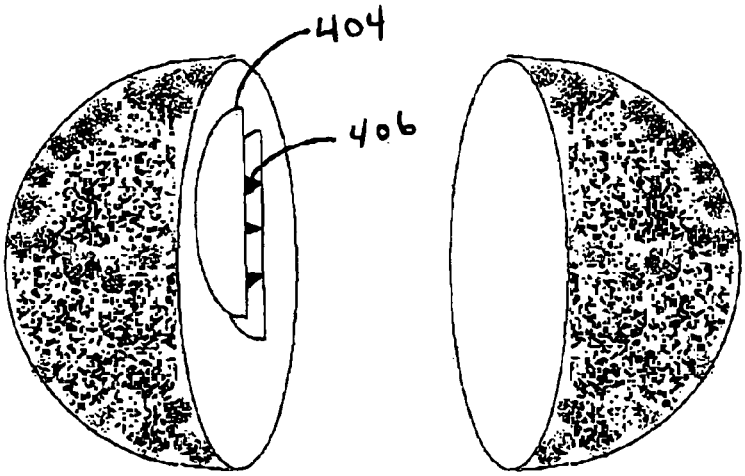
Figure 4C:
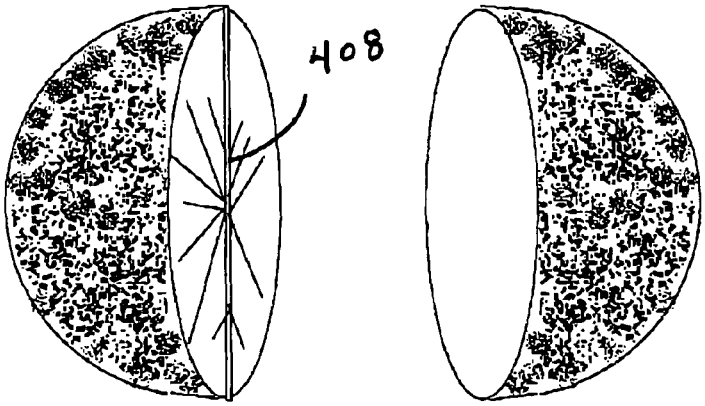

FIGS. 4*a*-4*c* illustrate the internal structure of the snow sphere 400. The adhesion surface 402 is also shown on the outer surface of the snow sphere 400. FIG. 4*a* illustrates that the interior of the snow sphere 400 may be hollow. It may also be made of a material that is light weight yet adds support and strength to the snow sphere, such as styrofoam, graphite, or other known light weight materials. The light weight materials may either fill the interior or be arranged to leave spaces, such as in a baffled, corrugated or matrixed arrangement.

One technical aspect of building a snow man/woman that needs to be mentioned here is that it is helpful that the snow boulder be of sufficient weight in order to compress the snow beneath. This causes the snow to partially melt and bond with the adhesion surface or snow bearing on the adhesion surface in a process called snow sintering. In that case, it is helpful-if the interior of the snow sphere is filled with a light weight material that is substantially lighter than compacted snow, yet has sufficient weight to act as a ballast material to cause the snow boulder to compress the snow beneath sufficiently to cause snow sintering. However, this is merely a variant of the invention and the invention performs sufficiently well without such a ballast particularly when the snow sphere is comprised of a material that is sufficiently hefty, such as plastic.

Also, when the snow sphere is covered in snow, the snow itself acts as a ballast and additional ballast may not be required.

FIG. 4*b* illustrates a variation of the invention, wherein the interior is formed by ribs or baffles 404 that contact or are fixed to an interior surface of the snow sphere. The ribs may include cross ribs 406 for added strength. The idea of the ribs is to add strength to the snow sphere, yet leave open spaces of air or light weight material, in order that the overall weight of the snow sphere is significantly less than a snow boulder of similar size. The ribs may or may not be uniform and may be of the same material as the outer snow sphere shell.

FIG. 4*c* illustrates yet another variant of the interior of the snow sphere. Here, the interior is arranged with spokes. The spokes, similar to the ribs, provide added support and strength to the structure of the snow sphere. The spokes may be one or more elongated rods that span any arc inside the snow sphere and are fixedly connected to the interior surface of the snow sphere at distal ends of the rod. The spokes may also be connected at intermediary points along the rod, such as spokes on a bicycle wheel. The spoke may be uniformly spaced, or non-uniformly spaced. Of course, in the case of spokes, it is preferable that the spokes are uniformly spaced in order to ensure that the strength of the structure is uniform at generally every point on the outer surface of the snow sphere.

Figure 5A:
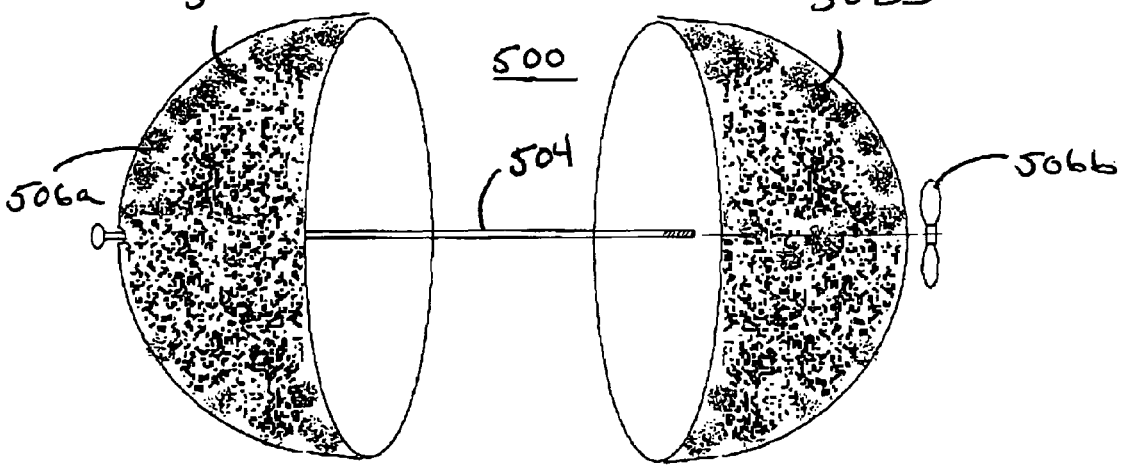
FIGS. 5*a-b* illustrate a connection mechanism of the invention.
Figure 5B:
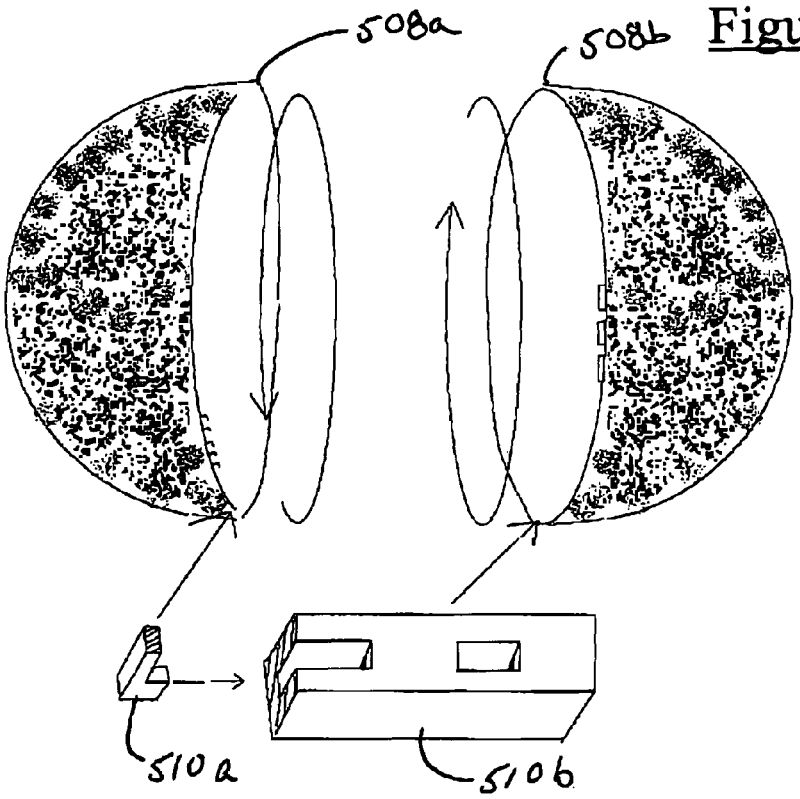

FIGS. 5*a* and 5*b* illustrate a variant of the snow sphere 500. For ease of production, storage and stocking, the snow sphere may be produced and sold in one or more portions. Here, there is shown that the snow sphere is provided in two half or hemi-spheres 502 *a, b*. In this case, it is also within the invention to create one hemi-sphere slightly smaller, so that it fits within the concavity or cavity of the other sphere. With this arrangement, the snow sphere hemispheres may be stored or stocked by placing one hemisphere inside the other, thereby greatly reducing space required for storage of the snow sphere. It also makes transport from the store easier.

At any rate, if the snow sphere is arranged in portions, then there should be provided a manner in which to connect the hemispheres. In FIG. 5*a*, a connection scheme is shown in which there is provided by the invention a rod or rods that fasten each hemisphere to each other. In its simplest form, the rod may be inserted through distal ends of the snow sphere and fixed at both ends in order to cinch the two halves together. In one embodiment, there may be a stopper at one end to hold one hemisphere against the other and a nut, or wing nut, threaded on threads formed on the other end. When the wing nut is tightened, providing that the rod is slightly large than an outer diameter of the snow sphere, the wing nut eventually bears on the outer surface of the snow sphere drawing the other end of the rod toward the wing nut end. When the stopper, which should be larger than a hole in the end of the hemisphere, bears against its side, the stopper causes the other hemisphere to bear against the opposing hemisphere. Thus, the two halves are brought together at their circumferences into close engagement and forming a single snow sphere. In one variant, the rod may be provided with one or more opposing threads at either end and threaded mates inside the interior of the snow sphere, whereby the hemispheres are fixed together by screwing the threaded end or ends into the mating socket inside the opposing hemisphere.

FIG. 5*b* illustrates a variant in fixing the hemisphere together in that mating edges 508 *a, b* are provide on the lip of the bearing circumference of each hemisphere. In one aspect, the mating edges may be lock type edges, shown here as L-shaped hooks 510 *a* and mating sockets 510*b*. The hemispheres are brought together so that the mating surfaces are in close engagement and the L-shaped hooks are bearing into open regions in the opposed mating edge. The hemispheres are counter rotated with respect to each, thereby sliding the L-shaped hooks into the recesses of the opposed mating edge, thereby locking the hemispheres into place. Of course, any type of mating edge, including mating edges that snap together, may be used in the present invention.

The invention also encompasses a number of snow spheres arranged to facilitate the construction of a snow man/woman. Normally, the invention works well simply by stacking the snow spheres covered with snow atop one another. The lighter weight allows one or more people to heft the torso onto the trunk snow sphere. The builder may also flatten or make a depression in the top of the trunk snow sphere in order to provide a platform for the torso snow sphere to rest.

Figure 6A:
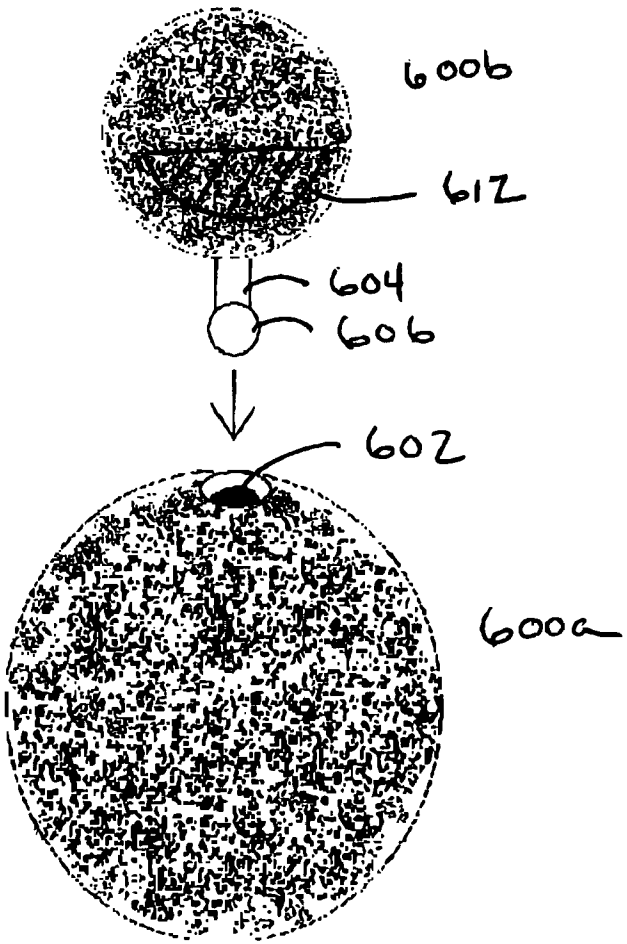
FIGS. 6*a-b* illustrate adjoining components of the invention.
Figure 6B:
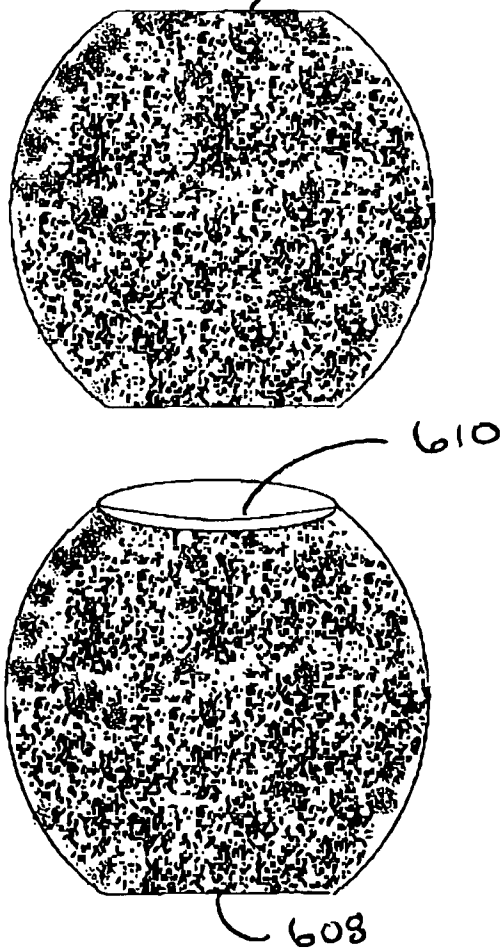

FIG. 6*a* illustrates a variant of the invention how the snow spheres 600*a, b* of the present invention may be adjoined. In this variant, there is provided in one of the spheres a hole 602 that is dimensioned to receive a protruding portion 604 that is connected to sphere 600*b*. The protrusion 604 may include a locking ball 606 that is slightly larger than the diameter of the hole 602, such that when the protrusion is inserted into the hole the sphere 600*b* is locked into the sphere 600*a*. FIG. 6*b* illustrates another variant of the adjoining mechanism. Here, the sphere may include a flat surface 608 or a depression 610. The flat surface or depression facilitates balancing the snow boulders atop each other.

Another variant illustrated by FIG. 6*a* is that the snow sphere may include feature indentations. Here, there is shown a mouth cavity already placed in the snow sphere. When the snow sphere is formed with snow, the mouth cavity will form the shape of an open mouth, thereby facilitating later forming the mouth. Other feature indentations are within the scope of the invention.

Figure 7B:
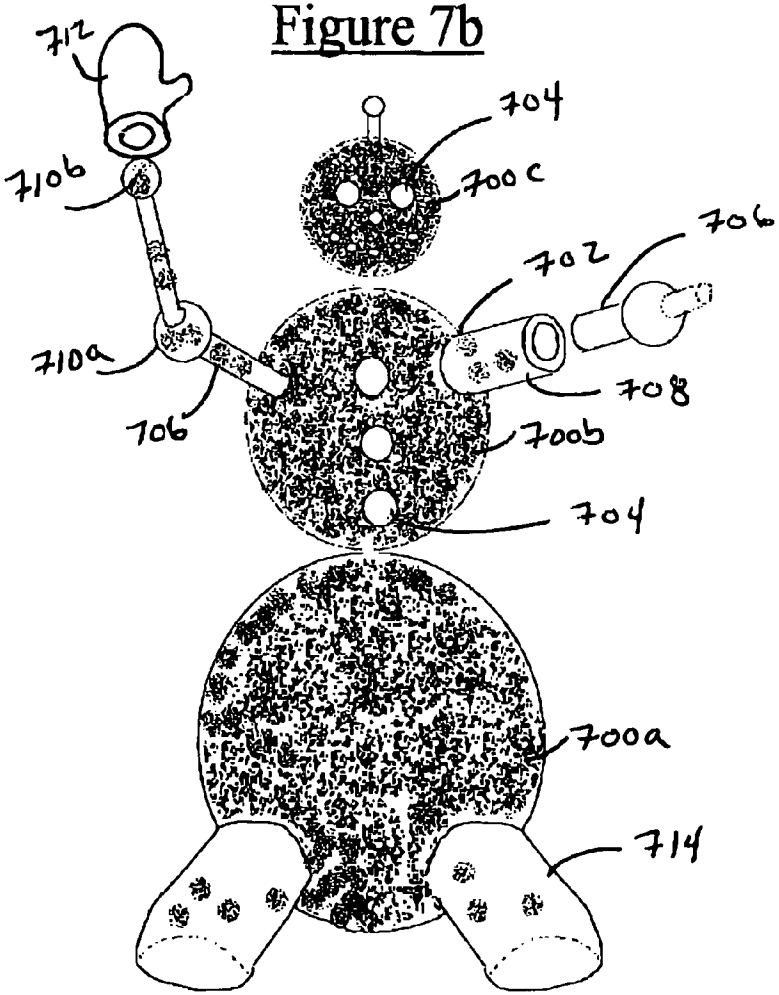
FIGS. 7*a-b* illustrate compositions of the invention.
Figure 7A:
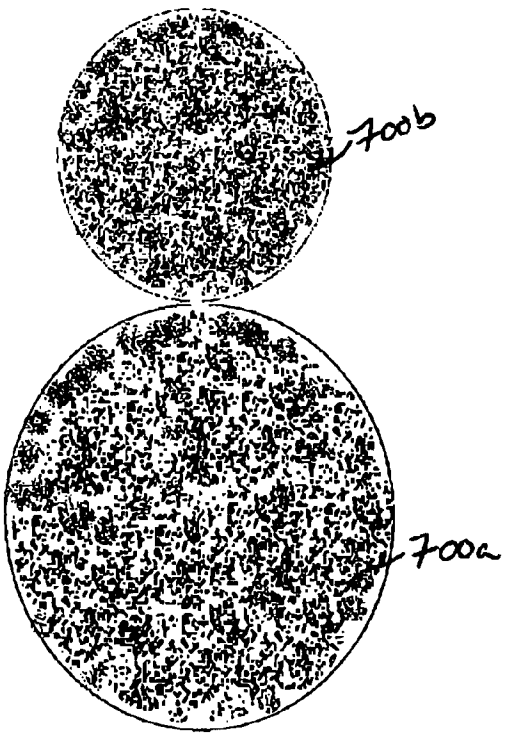

The invention further encompasses the compilation of the snow spheres together. FIG. 7*a* illustrates two snow spheres stacked on top of each other. FIG. 7*b* illustrates three spheres stacked on top of each other, namely the snow sphere trunk, torso and head 700 *a, b, c*, stacked on top of each other. Of course the invention encompasses the compilation of any number of snow spheres of the present invention.

FIG. 7*b* illustrates a further aspect of the invention, namely attachements. The attachements facilitate the building later of the appendages or features of the snow man/woman. In one aspect, the attachements comprise a receiving portion or socket 702, such as a depression or hole in the snow sphere and a mating stalk. In another aspect, there may be depressions 704 where facial or decorative features, such as buttons, may be stuck into. Turning now in more detail to the atachements, they may be an armature attachment for a left or right arm 706 and may comprise several attachable or pre-attached parts. There may be, for example, a sleeve 708 for receiving another attachement. There may be, for example, joints, such as an elbow or wrist 710 *a,b*, respectively. The joints may be formed with pre-placed holes to receive corresponding appendages. There may also be a hand or hands, here shown in the shape of a mitten, 712 having a corresponding hole sized to mate with the wrist joint 710*b*.

Or the joints may comprise a ball bearing, hinged, or equivalent movable joint. With the moveable joint, the builder may pre-set the appendages in various positions, such as a hand wave. The joints may be lockable joints, such as a ratcheted joint. The details of joints and locking joints will not be discussed in detail as such technology is widely known.

The attachements may also comprise leg, or trunk stands 714. The trunk stand receiving portions, such as a stem or hole, are strategically place on the snow sphere in order to balance the trunk show sphere and the supporting load. The attachements may also include a stem for receiving the hat (or bonnet) of the snow man or woman. As shown in the figure, the attachements may also have a snow adhesive outer surface, similar in construction to the adhesive surface discussed above for the snow sphere.

In operation, the snow spheres are constructed and laden with snow. This may be done by applying a layer of snow, as discussed above, and then rolling the snow sphere in snow. This may also be achieved by patting on the snow. Or, the snow spheres may be prepared simply by rolling the snow spheres in snow and allowing the adhesive surface to collect the snow. The snow sphere are placed on top of each other. No problem because the spheres are much lighter than a normal snow boulder. Alternatively, the snow boulders may be placed on top of each other and then snow patted on. However, this is not so easy because the snow covered snow spheres balance better when placed on top of each other.

The snow doesn't collect in the holes where the attachments are to be placed, allowing the builder to insert the attachements into the snow sphere. Of course, the builder manually positions the snow sphere's in the correct orientation so that the left and right arms, hat attachement, etc are in the correct position. In the case where the invention includes the variant of the adjoinments, then the attachement holes are pre-placed in the corresponding positions relative to the adjoinments. In this latter case, the builder need not worry about the orientation since the adjoinment of the snow spheres will automatically align the attachements and associated holes or attachement points.

Figure 8A:
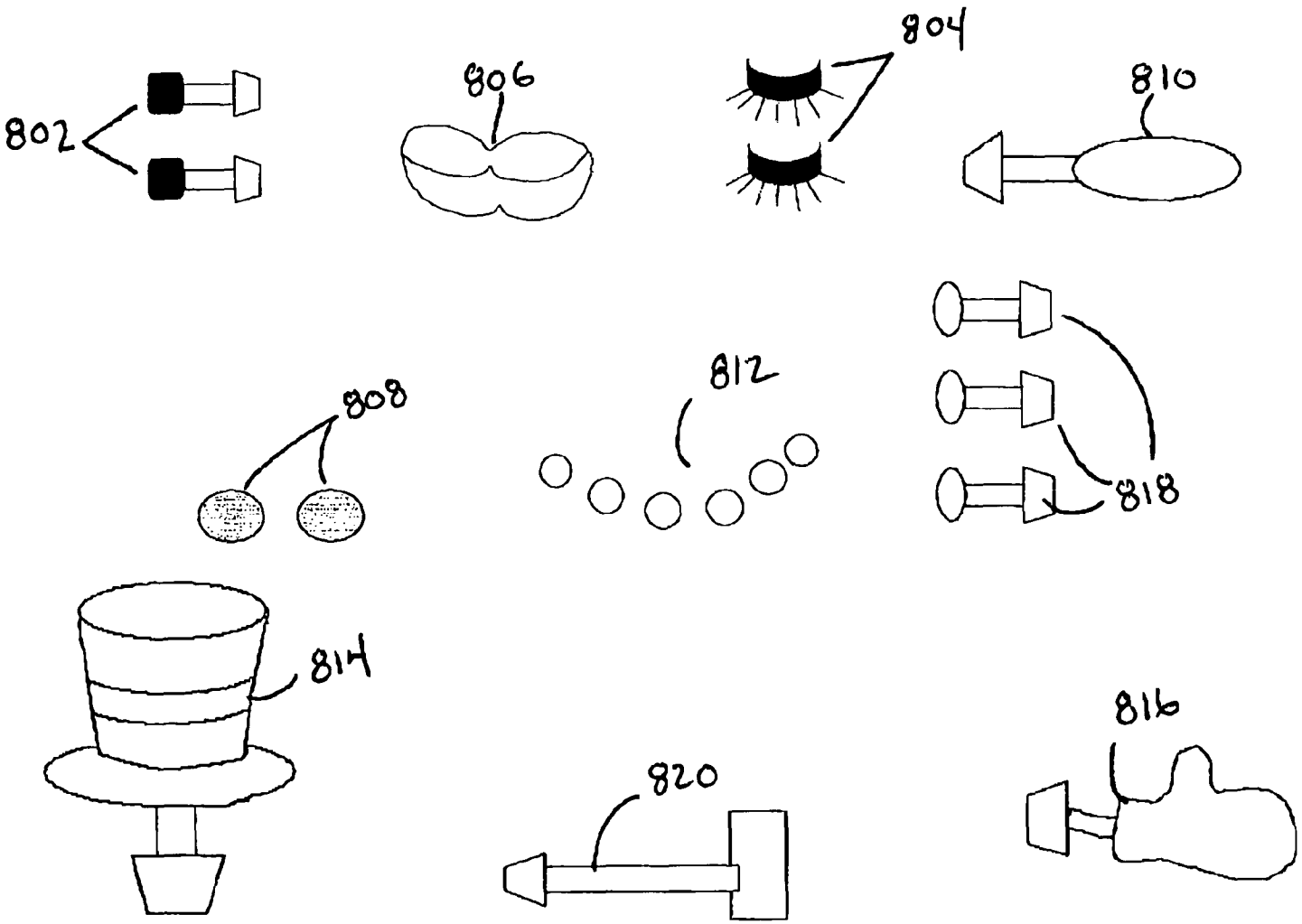
FIG. 8*a* illustrates attachments of the invention.
Figure 8B:
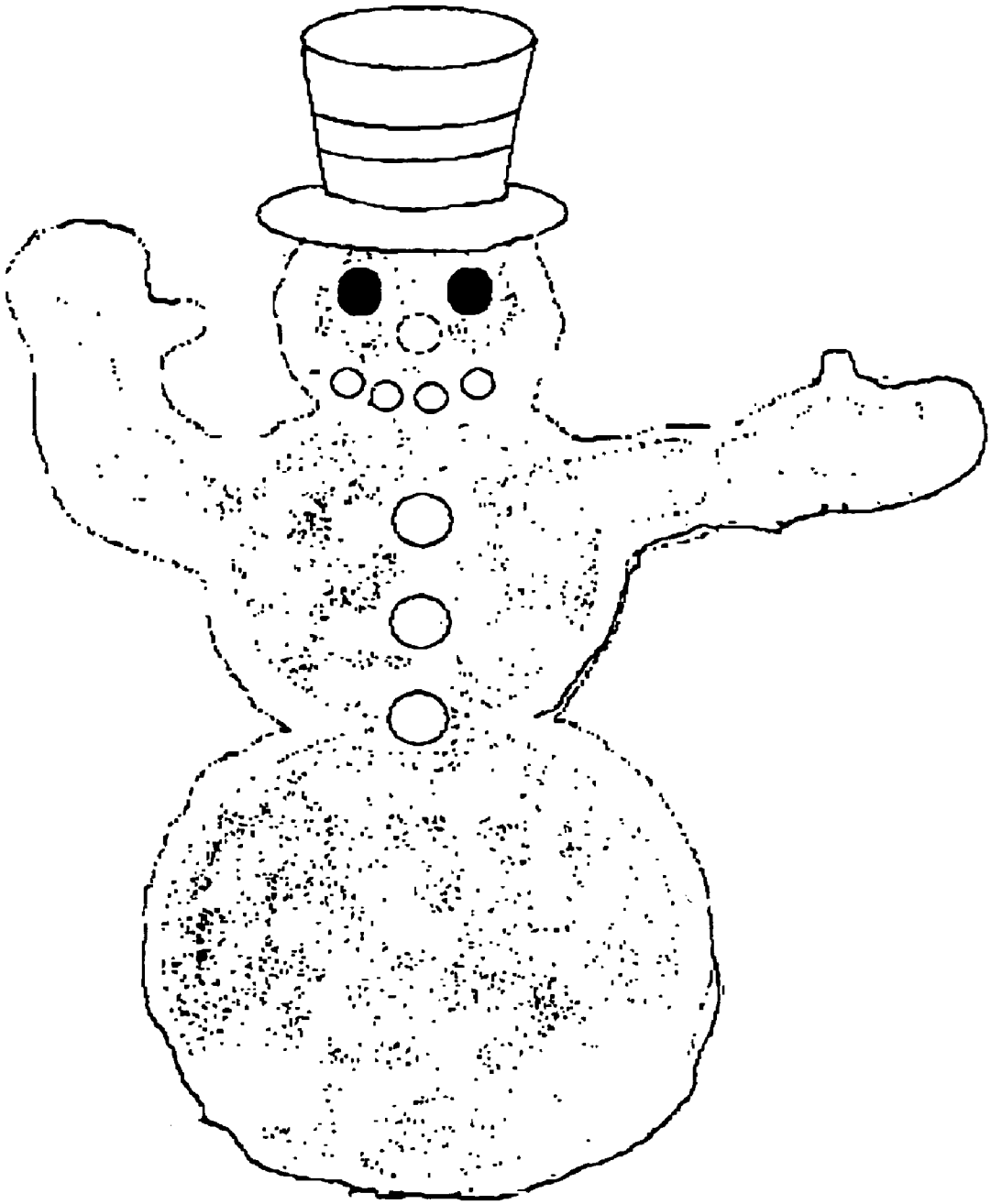
FIG. 8*b* illustrates a possible final product of the invention.

Turning now to FIGS. 8*a* and 8*b*, we come now to the accoutrement aspect of the invention. As mentioned above, wind and melting tend to alter the position of the features and decorations of the snow man/woman. Also, the quality of the snow effects the placement of such accoutrements. Cold snow has a poor friction coefficient, as compared with wetter or moister snow. Thus, the present invention provides accoutrements or accessories that include attaching mechanisms that allow the accessory to be firmly attached or inserted into the snow of the snow person and fixedly placed there.

As shown in FIG. 8*a*, there are various attachments. In one aspect, there are provided facial features, such as eyes 802, eye lashes 804, lips 806, rosy cheeks 808, nose 810 or mouth 812. Of course, not every variation of the attachments are shown. The eyes, here, are shown to be made out of black, coal brick-like, members. However, any type of eyes, including those with pupils, may be used. The lips may be in any form, not only together as shown here, but open, pursed, smiling, with teeth, etc.

The attachments may also be decorative or clothing. There is a top hat 814, mittens 816, buttons 818, or corn pipe 820. Of course, there may be other attachments, such as a scarf, or other adournment. Also, the attachments shown here are not the entire range or scope of the item shown. The hat may be a baseball or school boy cap, a bonnet, a wizard hat, a cowboy hat, a preacher hat, a fisherman's hat and on and on. The mittens may be instead a hand, a gloved hand, a baseball mit, etc. The buttons may be any shape or color. The pipe may be a cigarette, a lollipop stick, etc.

The attachments are provided with a manner in which to attach the accoutrement. Here, there is shown a stem attached to the accoutrement at the insertion end of the item. There may also be a barb, spade-shape or arrow-shaped spear head. The idea is that the graded side is inserted first into the snow and the blunt or orthogonal side faces the outer surface of the snow. The orthogonal side acts against the snow, making it more difficult to remove the inserted attachment. The spade is contemplated as the better of these options to prevent injury to children or adults. The attachment may be twisted, like a key in a lock, once inserted in order to align the orthogonal side with snow. There may, alternatively be provided a screw or cork-screw style attaching mechanism.

FIG. 8*b* illustrates the finished product. The ultimate snow man 822. The ultimate snow man is not to be defined by the adornments or appendages but, rather, chiefly defined by its shape. The symmetry of the snow spheres is a factor better than that can be achieved using the traditional snow person building style. More than that, the ultimate snow man/woman is more easily built, taking far less time than in the past. Of course, the attachments and arm appendages add to the superiority of the ultimate snow man/woman over the snow people of afore. Additionally, the size of the ultimate snow person can be made much larger than normal, owing to the ability to easily manipulate and heft the snow spheres.

The present invention also comprises a method of manufacture. Various manners in which to manufacture the invention are contemplated. In one variation, it is contemplated constructing a spherically-shaped body. The spherically-shaped body has an outer surface and an interior. The interior should be constructed to have a substantially lighter weight than when the interior is filled with snow. An adhesion surface is formed on the outer surface of the spherically-shaped body that substantially increases the ability of the outer surface to adhere snow to the spherically-shaped body, thereby forming the building block for facilitating the construction of the snow man/woman.

Figure 9:
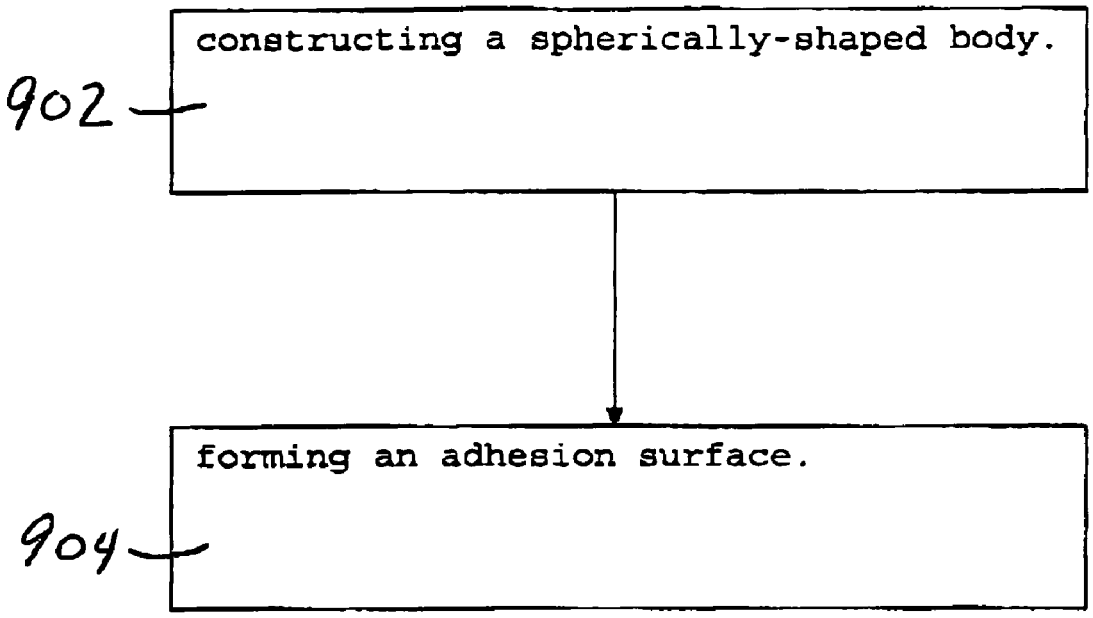
FIG. 9 is a flow diagram for manufacturing the invention.

The fundamental method 900 is shown in FIG. 9. In step 902, the spherically-shaped body is formed. Coinciding, or thereafter, the adhesion surface is formed on the outer surface of the spherically-shaped body in step 904.

The invention manufactures the snow sphere, in one concept, by using a mold. In one aspect, the spherically-shaped body and adhesion surface together are formed in the same mold. For example, this may be ideal for a snow sphere created from plastic, hard rubber, or some other mold amenable material.

The snow sphere may be formed in another manner. In the case that the snow sphere is made with holes or openings as the adhesion surface, the adhesion surface holes may be created by boring holes into the spherically-shaped body. In the case that a mold is used, the openings may be formed by including in the mold protrusions corresponding with the openings.

The invention also contemplates manufacturing different sizes of the spherically-shaped body for respective body members of the snow man/woman. In a variant, the invention provides packaging for sale at least two sizes of the spherically-shaped body corresponding to respective body members of the snow man/woman.

Figure 10A:
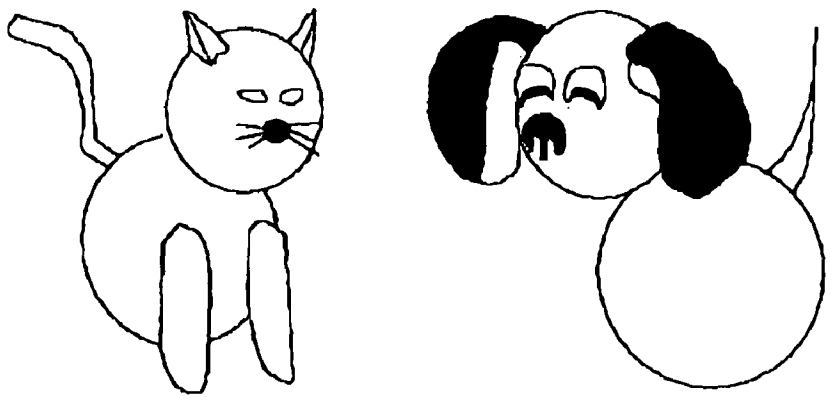
FIGS. 10*a* and 10*b* illustrates a variant on the caricatures of the invention.
Figure 10B:
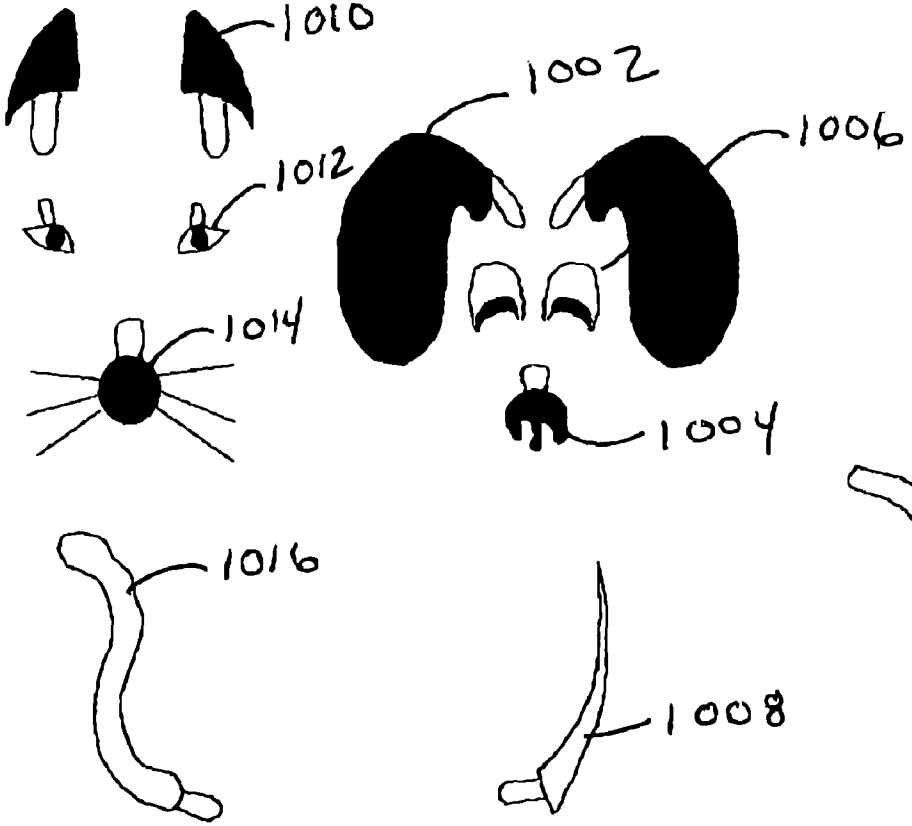

While the main invention envisions providing a snow sphere or spheres for a snow person, it should be bourn in mind that the invention also encompasses a snow humanoid. In the case, for example, that the person building the snow man wishes to build a snow monster, this should not matter to the invention. For that matter, the invention encompasses a snow animal, such as a cat 1000*a* or dog 1000*b* as shown in FIG. 10*a*, or an exotic animal, such as a giraffe or elephant, or any other animal for that matter. FIG. 10*b* illustrates attachments for the snow animal including doggie ears 1002, schnoz 1004, sappy eyes 1006 or waggy tail 1008. Alternatively, for the cat version, there may be provided cat ears 1010, Siamese eyes 1012, nose and whiskers 1014 or poofy tail 1016. Of course, these features may also be other than that shown.

Another example of a humanoid would be an alien. An additional feature of the invention is to provide snow "man" kits, whereby the accoutrements, for example, face and/or body parts/clothes/accessories are sold separately in packets for each type of snow being.

It is known as mentioned in the background that precipitation, particularly dry snow, can have a static electric charge and, important to this invention. It is not exactly understood how these principles work. Faraday himself did many experiments with snow and, despite having discovered Faraday's law, was unable to fully explain the physical nature of snow. It seems to be, however, that dry snow is susceptible to higher friction when skis slide over them. As mentioned, the friction increased can be up to 65%. It is suspected this has something to do with static electricity.

The solution here proposes to turn it around. Namely, instead of reducing static electricity, or its effects, as desired by the skiing industry; here we seek to increase the static electricity or effects in order to cause the snow, particularly dry snow, to adhere to the snow sphere.

Experimentation was conducted and it was found that by rubbing a plastic snow sphere with wool, in other words imparting a static charge on the snow sphere, it had the ability to attract dry crystals of snow. Hence, the proposal here also encompasses a snow sphere that has an outer surface that is or can be made to carry a static charge (positive or negative).

In this case, the adhesion surface is a static charge bearing surface. In other words, the snow sphere may be smooth. However, in order to provide a snow sphere that works well in both dry and wet snow, it is proposed to combine such a static charge bearing snow sphere with one that has a texture or surface that is formed to adhere wet snow. With such a device, a snow man can be built in both wet or dry snow conditions. In addition, the combination of the textured surface and static charge make it easier for the dry snow to be trapped in the nodule depressions or holes of the snow sphere.

The proposal has in mind to employ a material that naturally or easily takes on a static charge. In other words, no additional devices are needed to apply the charge to the snow sphere. Such materials having a high static charge capability include, but not limited to, plastic, glass, fibre glass and Styrofoam. This is advantageous because the proposal provides a unitary, contiguous piece of material and it is then not necessary to have additional components of the invention.

However, a variant of the proposal includes providing a device for applying the static charge to the snow sphere. This device may be a wool piece of fabric that the user manually rubs the snow sphere in order to strip the electrons from the sphere, much the way we all did in science class with a glass rod and fur piece of material. In addition, the proposed solution may include a static charge machine, such as a Van der Graaff machine or other suitable device for creating an electric charge, including the use of a dielectric charged that holds a charge.

Figure 11A:
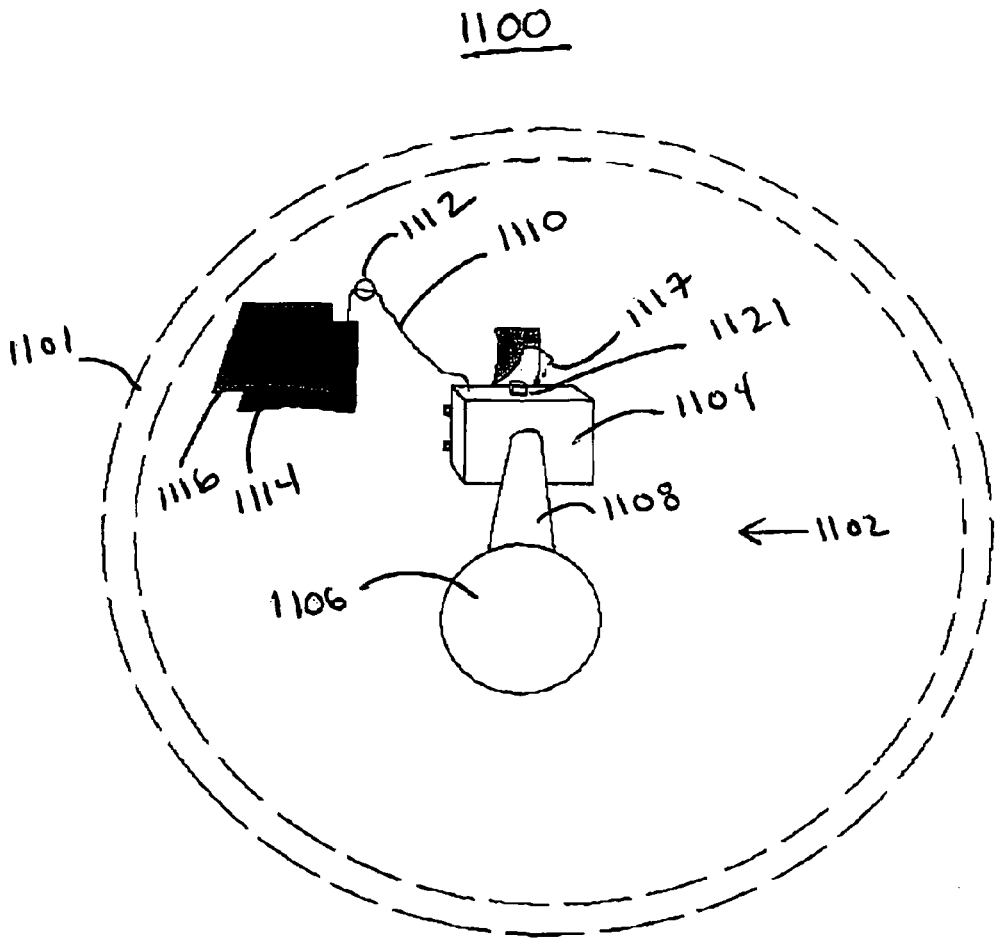
FIGS. 11*a* and 11*b* illustrate an improved version of the invention.
Figure 11B:
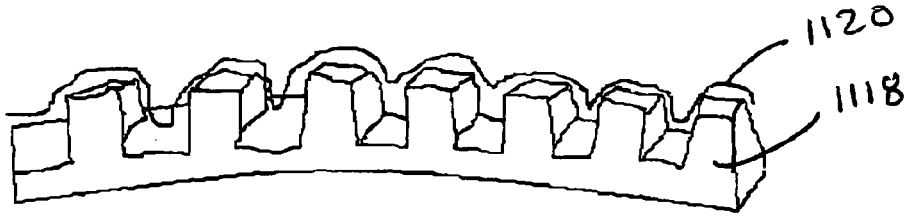

FIGS. 11*a*-11*c* illustrate such an apparatus 1100 for a snow sphere 1101 is shown. The interior of the sphere is here shown and disposed therein is an electric (static) charge generator 1102 which includes a Van der Graaff machine 1104 that generates an electro-static charge according to known principles. The device is shown here to be mounted on an interior surface of the snow sphere, but may be suspended inside the sphere. There is also a charge reservoir 1106 where the charges that are stripped from the surface of the snow sphere 1101 are stored.

The charge reservoir 1106 here is in the classic Van der Graaff form of a sphere is preferably suspended inside the snow sphere and away from its surface. This is to prevent the positive charge built up there from jumping to the snow sphere 1101. The reservoir may be suspended by a shaft or any structure 118. Inside this structure may be formed the belt mechanism (not shown) of the state of the art Van der Graaf machine. The details of the Van der Graaff are so well known that it is not necessary to describe them here for enablement or any other written requirement.

In another variant, the Van der Graaf machine may be configured to deposit a positive charge on the outer sphere (i.e., in case the snow particles are positively charged). In that case, the outer surface of the snow sphere itself becomes the reservoir earlier mentioned of the Van der Graaff machine.

However, for the sake of completeness and complete clarity, I add here a description of how a Van der Graaf generator works and is employed. A motor is turned on and rotates a lower roller (charger) which is coupled to a belt. The belt is made of rubber and the lower roller is covered in silicon tape, for example. The lower roller begins to build a negative charge and the belt builds a positive charge. This is because silicon is more negative than rubber; therefore, the lower roller is capturing electrons from the belt as it passes over the roller. The charge on the roller is much more concentrated than the charge on the belt. Because of this concentration of charge, the roller's electric field is much stronger than the belt's at the location of the roller and lower brush assembly.

The belt is positively charged and rolls toward the upper roller and upper brush assembly. An upper roller is coupled to the belt on the upper end. Using nylon as the upper roller, it wants to repel the charge on the belt. An upper brush assembly is connected to the inside of the Van der Graaff sphere and hangs near the upper roller and belt location. The electrons in the brush move to the tips of the wires because they are attracted to the positively charged belt. The brush is connected to the inside of the Van der Graaf sphere and takes away all of the charge, leaving the object neutral. The excess charge then shows up on the outside surface of the container.

Again, the Van der Graaff generator is well known and need not be shown in the figures in any more detail. The important aspect here is that the charge generator is inside the snow sphere. As far as I know, inverting a Van der Graaff machine in this manner (that is placing the motor, rollers, etc. inside the charging sphere) has never been done. In the present invention, this allows the charge generator to be within the snow sphere so as not to disturb the spherical contour for snowman building. Also, it is preferable that the charge generator is not a separate unit.

Also in the FIG. 11*a* is shown a conductor for conducting the charges, via a hole or other conduit 1112, to the outer surface of the snow sphere. To distribute the charge more evenly, and by action of the laws of physics, the outer surface may be or coated by a conductive or semi-conductive surface 1114. A non-conducting insulator 1116 may be coated on this conductive surface in order to maintain the charges therein.

FIG. 11B is a magnified view of the outer surface of the snow sphere with nodules coated (or made from) the conductive or semi-conductive material 1118. A coating 1120, here grossly exaggerated, coats the nodules. Preferably the coating will be thin enough not to interfere with the spacing between the nodules. Where the snow sphere involves holes, the charged surface will attract the snow into the holes.

Referring back to FIG. 11*a*, there may also be an access panel 1117 provided in the outer surface of the snow sphere and which conforms to the contour thereto (in order to maintain the spherical surface). The access panel may allow access to a switch 1119 that allows the builder to switch on the charge generator, thereby causing the charge generator to initiate building a charge on the outer surface of the sphere.

There may also be a circuit 1121 for automatically cutting off the charge generator after a period of time or when a certain charge is attained, in order to prevent shock from excessive charge build up on the outer sphere.

The charge generator 1104 in FIG. 11A may also be a battery or other energy source for delivering a charge to the outer surface of the snow sphere 1101 via the conductor 1110. In this case, the outer surface and non-conductive coating 1120 comprise a dielectric whereby charges on the conducting side build up around the surface of the snow sphere (dispersed around the sphere by action of physics, that is the charges seeking to spread out away from each other and uniformly around the sphere). Oppositely charged snow is thus attracted and adheres to the coating 1120 by electric field action.

In operation, the electrically charged surface forms the adhering surface of the present invention. Thus no textured surface is necessary. The snow sphere is rolled as before and the static charge attracts the snow to the snow sphere. When the snow sphere is completely covered in a layer of snow, the snow layer forms the necessary binding agent needed to attract more snow.

In any event, the electrically charged outer surface may be combined with the textured surface of the embodiments above. In that case, both act and assist the other; the electrically charged surface assisting in the attraction of dry snow into the spaces of the nodules (or holes) and the nodules or holes suitable for adhering wetter snow thereto.

The present invention has been described with reference to specific embodiments or variants. However, it shall be bourn in mind that modifications or variations to the present invention may be practiced that are still within the spirit and scope of the present invention.

The invention claimed is:

1. A building component apparatus for facilitating a construction of a snow man/woman, comprising:

a spherically-shaped body that provides an interior structure of the snow man/woman that has an outer surface and an interior, the interior substantially lighter than when the interior is filled with snow;

an adhesion surface provided on the outer surface of the spherically-shaped body that substantially increases the ability of the outer surface to adhere snow to the spherically-shaped body;

wherein, the spherically-shaped body and adhesion surface form a building component for facilitating the construction of the snow man/woman; and a generator that generates an electric charge, the electric charge coupled to the outer surface.

2. The apparatus of claim 1, further comprising that the snow building component is a body part of the snow man/woman selected from the group consisting of a trunk, torso, or head.

3. The apparatus of claim 1, further comprising that the adhesion surface is comprised of nodules.

4. The apparatus of claim 3, wherein the generator is disposed within the spherically-shaped body.

5. The apparatus of claim 1, further comprising that the adhesion surface is comprised of holes in the outer surface of the spherically-shaped body.

6. The apparatus of claim 1, further comprising that the spherically-shaped body is substantially hollow.

7. The apparatus of claim 1, further comprising at least one rib connecting at least two points along an interior surface of the spherically-shaped body for providing additional structural support to the outer surface of the spherically-shaped body.

8. The apparatus of claim 1, further comprising at least one spoke connecting at least two points along an interior surface of the spherically-shaped body for providing additional structural support to the outer surface of the spherically-shaped body.

9. The apparatus of claim 1, further comprising that an interior surface of the spherically-shaped body comprises a material of light weight as compared with compacted snow for providing additional structural support to the outer surface of the spherically-shaped body.

10. The apparatus of claim 1, further comprising that the spherically-shaped body is comprised of two separable hemispheres that, when brought together, form the spherically-shaped body.

11. The apparatus of claim 1, further comprising an adjoinment that is connectably mounted to the building component for receiving another such building component.

12. The apparatus of claim 1, further comprising at least one attachment that is connectably mounted to the building component that forms a skeletal structure for an appendage of the snow man/woman.

13. The apparatus of claim 1, further comprising at least one feature having fixing means for inserting the feature into the snow man/woman, thereby fixing the feature to the snow man/woman.

14. The apparatus of claim 13, further comprising that the feature is selected from the group consisting of: an eye, a nose and a mouth.

15. A building component apparatus for facilitating a construction of a snow man/woman according to claim 1, wherein the generator is provided to generate a sufficient electric charge to attract and adhere snow to the outer surface.

* * * * *